US012653361B2

(12) United States Patent
Shi et al.

(10) Patent No.: US 12,653,361 B2
(45) Date of Patent: Jun. 16, 2026

(54) DUST ACCUMULATION BASE AND CLEANING APPARATUS ASSEMBLY HAVING SAME

(71) Applicants: JIANGSU MIDEA CLEANING APPLIANCES CO., LTD., Suzhou (CN); MIDEA GROUP CO., LTD., Foshan (CN)

(72) Inventors: Chunbing Shi, Suzhou (CN); Xia Xu, Suzhou (CN)

(73) Assignees: JIANGSU MIDEA CLEANING APPLIANCES CO., LTD., Suzhou (CN); MIDEA GROUP CO., LTD., Foshan (CN)

( * ) Notice: Subject to any disclaimer, the term of this patent is extended or adjusted under 35 U.S.C. 154(b) by 632 days.

(21) Appl. No.: 17/609,400

(22) PCT Filed: May 6, 2020

(86) PCT No.: PCT/CN2020/088820

§ 371 (c)(1),
(2) Date: Nov. 7, 2021

(87) PCT Pub. No.: WO2020/224601

PCT Pub. Date: Nov. 12, 2020

(65) Prior Publication Data

US 2022/0218168 A1 Jul. 14, 2022

(30) Foreign Application Priority Data

May 7, 2019 (CN) ..... 201910375726.6
May 7, 2019 (CN) ..... 201910375735.5
(Continued)

(51) Int. Cl.
*A47L 5/24* (2006.01)
*A47L 9/00* (2006.01)
(Continued)

(52) U.S. Cl.
CPC ..... *A47L 9/149* (2013.01); *A47L 5/24* (2013.01); *A47L 9/0063* (2013.01); *A47L 9/1409* (2013.01); *A47L 9/2873* (2013.01)

(58) Field of Classification Search
None
See application file for complete search history.

(56) References Cited

U.S. PATENT DOCUMENTS 2,544,405 A * 3/1951 Weir ..... A47L 9/0063 280/43.15
2,603,816 A * 7/1952 Macfarland ..... A47L 9/0063 15/246.2
(Continued)

FOREIGN PATENT DOCUMENTS

CN 101992190 A 3/2011
CN 202751328 U 2/2013
(Continued)

OTHER PUBLICATIONS

Search Report for EP application 20802704.5; mailed Jun. 22, 2022.
(Continued)

*Primary Examiner* — Monica S Carter
*Assistant Examiner* — Jonathan R Zaworski
(74) *Attorney, Agent, or Firm* — K&L Gates LLP

(57) ABSTRACT

A dust accumulation base and a cleaning apparatus assembly having same are disclosed. The dust accumulation base includes: a dust collection part, the dust collection part being internally provided with a dust collection chamber used for collecting dust in a cleaning apparatus, and the dust accumulation base being provided with a dust inlet communicated with the dust collection chamber; and a support part, the support part being used for supporting the cleaning apparatus, and the support part being provided with an
(Continued)

avoidance area capable of accommodating or avoiding an air suction accessory of the cleaning apparatus.

44 Claims, 9 Drawing Sheets

(30) Foreign Application Priority Data

May 7, 2019 (CN) ..... 201920639380.1
May 7, 2019 (CN) ..... 201920645836.5
May 7, 2019 (CN) ..... 201920646692.5

(51) Int. Cl.
*A47L 9/14* (2006.01)
*A47L 9/28* (2006.01)

(56) References Cited

U.S. PATENT DOCUMENTS 2,608,709 A * 9/1952 Cordelia ..... A47L 9/0027 15/327.2
5,606,767 A * 3/1997 Crlenjak ..... B24B 55/06 15/301
6,317,920 B1 11/2001 Brickner et al.
6,434,784 B1 * 8/2002 Wisser ..... B24B 7/18 15/301
6,572,668 B1 * 6/2003 An ..... A47L 9/1683 55/459.1
6,883,202 B2 * 4/2005 Steffen ..... A47L 9/00 15/331
7,386,916 B2 * 6/2008 Bone ..... A47L 9/2884 55/299
7,604,675 B2 * 10/2009 Makarov ..... A47L 9/1641 55/432
7,740,676 B2 * 6/2010 Burnham ..... A47L 9/1633 55/459.1
8,756,751 B2 * 6/2014 Jung ..... A47L 9/2805 15/319
9,155,431 B2 * 10/2015 Dyson ..... A47L 9/0063
9,161,669 B2 * 10/2015 Conrad ..... A47L 9/20
9,192,272 B2 * 11/2015 Ota ..... A47L 9/106
9,271,618 B2 * 3/2016 Mantyla ..... A47L 5/24
9,757,001 B2 * 9/2017 Hwang ..... A47L 5/225
9,863,441 B2 * 1/2018 Eidmohammadi ... A47L 7/0009
10,159,990 B2 * 12/2018 Hua ..... B01D 45/04
10,214,349 B2 * 2/2019 Conrad ..... A47L 9/1683
10,244,909 B2 * 4/2019 Conrad ..... B65F 1/1607
10,244,910 B2 * 4/2019 Conrad ..... A47L 9/106
10,322,873 B2 * 6/2019 Conrad ..... B08B 17/00
10,464,746 B2 * 11/2019 Conrad ..... B65F 1/105
10,512,381 B2 * 12/2019 Meggle ..... A47L 9/12
10,555,653 B2 * 2/2020 Bower ..... A47L 9/1641
10,674,884 B2 * 6/2020 Conrad ..... A47L 9/2884
10,849,478 B2 * 12/2020 Conrad ..... A47L 5/36
11,213,177 B2 * 1/2022 Tonderys ..... A47L 9/12
11,357,372 B2 * 6/2022 Buening ..... A47L 9/2852
11,375,862 B2 * 7/2022 Ko ..... A47L 9/242
11,998,150 B2 * 6/2024 Innes ..... A47L 9/12
12,004,703 B2 * 6/2024 Kim ..... A47L 9/149
2002/0178535 A1 12/2002 Oh et al.
2013/0305481 A1 * 11/2013 Jung ..... A47L 11/33 15/301
2013/0335900 A1 * 12/2013 Jang ..... A47L 5/24 361/679.01
2017/0319034 A1 * 11/2017 Kim ..... A47L 9/2884
2018/0078107 A1 * 3/2018 Gagnon ..... A47L 9/20
2018/0125314 A1 * 5/2018 Kim ..... H01M 10/48
2021/0000313 A1 * 1/2021 Canning ..... A47L 9/0009
2021/0052121 A1 * 2/2021 Kim ..... A47L 9/1683
2021/0345848 A1 * 11/2021 Jeon ..... A47L 9/0063
2021/0345849 A1 * 11/2021 Takano ..... A47L 9/28

FOREIGN PATENT DOCUMENTS

CN 103844996 A 6/2014
CN 105708389 A 6/2016
CN 106923739 A 7/2017
CN 106923745 A 7/2017
CN 107405033 A 11/2017
CN 107997686 A 5/2018
CN 109124475 A 1/2019
CN 208573603 U 3/2019
CN 208582324 U 3/2019
CN 208677259 U 4/2019
CN 208808359 U 5/2019
CN 209953473 U 1/2020
CN 210124713 U 3/2020
CN 210124714 U 3/2020
JP 2015009030 A * 1/2015
JP 2017189453 A * 10/2017
WO WO-2016114046 A1 * 7/2016 ..... A47L 5/24
WO WO-2018093087 A1 * 5/2018 ..... A47L 5/225

OTHER PUBLICATIONS

First OA for CN application No. 201910375735.5.
First OA for CN application No. 201910375726.6.
ISR for PCT application No. PCT/CN2020/088820.
Second OA for CN application No. 201910375726.6.

* cited by examiner

DUST ACCUMULATION BASE AND CLEANING APPARATUS ASSEMBLY HAVING SAME

CROSS-REFERENCES TO RELATED APPLICATIONS

The present disclosure is a national phase application of International Application No. PCT/CN2020/088820, filed on May 6, 2020, which claims priority to Chinese Patent Application Nos. 201910375735.5, 201920639380.1, 201910375726.6, 201920645836.5, and 201920646692.5, all field on May 7, 2019, the entire contents of which are incorporated herein by reference.

FIELD

The present application relates to the field of cleaning apparatuses, and in particular to a dust accumulation base and a cleaning apparatus assembly having the same.

BACKGROUND

A cleaning apparatus usually includes a negative pressure assembly, a dust cup component and a suction head assembly. When the negative pressure component is started, the suction head assembly can generate negative pressure to suck dust in the environment, and supply the dust to the dust cup component for separating dust from air, thus achieving a cleaning effect; however, for a cleaning apparatus in a related art, it is inconvenient to dump dust.

SUMMARY

The present application is intended to solve at least one of the problems existing in the prior art.

For this reason, the present application is intended to provide a dust accumulation base. The dust accumulation base can be used to hold a cleaning apparatus and collect dust in the cleaning apparatus, which facilitates the dust dumping of the cleaning apparatus and improves the dust dumping effectiveness of the cleaning apparatus.

The present application further provides a cleaning apparatus assembly with the above-mentioned dust accumulation base.

An dust accumulation base according to an embodiment of the present application includes: a dust collection part, the dust collection part being provided therein with a dust collection chamber for collecting dust in the cleaning apparatus, the dust accumulation base being provided with a dust inlet in communication with the dust collection chamber; and a support part configured to support the cleaning apparatus, the support part being provided with an avoidance area that can accommodate or avoid a suction accessory of the cleaning apparatus.

According to the dust accumulation base of the present application, an avoidance area is designed for the suction accessory of the cleaning apparatus, so that the support part can hold the cleaning apparatus. The dust accumulation base can hold the cleaning apparatus with and without the suction accessory, avoiding the process of removing or installing the accessory before removal of dust out of the cleaning apparatus. The dust collection part is used to collect dust in the cleaning apparatus, which facilitates the dust dumping of the cleaning apparatus, improves the dust dumping effectiveness of the cleaning apparatus, and reduces the cleaning workload of a user. The dust accumulation base is both a place for collecting dust for the cleaning apparatus and a place for storing the cleaning apparatus. The dust can be removed immediately every time the cleaning apparatus is stored in the dust accumulation base, avoiding a case where the user forgets to dump the dust after using the cleaning apparatus.

In some embodiments, the support part includes a plurality of support sub-parts that can support the cleaning apparatus, the avoidance area is defined between at least two of the support sub-parts, and the avoidance area is open on one horizontal side and on two vertical sides, respectively.

In some embodiments, the support part is located above the dust collection part, and a side wall of the dust collection part is provided with an avoidance recess to avoid the suction accessory with a long tube.

Specifically, the avoidance recess is narrow at the top and wide at the bottom, and the avoidance recess is provided with an upwardly penetrating avoidance opening corresponding to the avoidance area.

In some embodiments, the housing of the dust collection part includes: a vertical box arranged vertically and having a front surface and two side surfaces, the front surface of the vertical box being wider than the side surface of the vertical box, the avoidance recess being formed in the front surface of the vertical box; and a horizontal seat horizontally coupled to a bottom of the vertical box.

In one embodiment, a bottom surface of the avoidance recess is flush with an upper surface of the horizontal seat, or the bottom surface of the avoidance recess and the upper surface of the horizontal seat are connected in an arc transition.

Advantageously, a storage chamber and the dust collection chamber are defined in the vertical box, and the storage chamber and the dust collection chamber are respectively arranged adjacent to the two side surfaces of the vertical box.

Further In one embodiment, the storage chamber and the dust collection chamber are both configured as chambers that can be opened, the dust collection part includes cover plates respectively arranged on the two side surfaces of the vertical box, one of the cover plates is configured to open and close the storage chamber, and the other cover plate is configured to open and close the dust collection chamber.

In some embodiments, the support part is coupled to the dust collection part by a strut. Alternatively, the support part and the dust collection part are separate parts, and the support part is fixed to an external object by a supporting and fixing assembly.

Specifically, the support part and the dust collection part are detachably connected by the strut, and/or the support part and the dust collection part are connected in an adjustable distance through the strut.

Further, the dust accumulation base further includes a dust bag detachably arranged in the dust collection chamber.

In some embodiments, the dust accumulation base is provided with a first power port to be coupled to a second power port of the cleaning apparatus.

Specifically, the first power port is arranged on the support part and located in the avoidance area.

In some embodiments, a dust passage chamber is defined in the dust accumulation base, the dust passage chamber includes a gathering chamber and a branch channel, one end of the branch channel is coupled to the dust inlet, the other end of the branch channel is in communication with the gathering chamber, and a bottom of the gathering chamber is provided with a dust collection opening in communication with the dust collection chamber.

Specifically, dust inlets are provided and branch channels are correspondingly provided. In a direction from the dust inlet to the gathering chamber, a flow area of each branch channel gradually decreases.

In one embodiment, the gathering chamber is located below the dust inlet, horizontal projections of the dust inlet and the gathering chamber do not overlap, and the branch channel is curved.

Further, the dust inlet and the dust passage chamber are both formed in the support part.

In some embodiments, the support part includes: a support bottom shell, a top of the support bottom shell being open to form a fitting opening, the dust collection opening being formed at the bottom of the support bottom shell; and a support seat shell fitted on the fitting opening, the dust inlet being formed in the support seat shell, the dust passage chamber being defined between the support seat shell and the support bottom shell.

In one embodiment, the fitting opening includes a central area and branch areas, and one ends of the plurality of branch areas respectively extend to the central area so that a contour line of the fitting opening becomes a closed circle; the dust collection opening is located below the central area, and the support bottom shell is shaped by gradually changing downward from a contour of the fitting opening to a contour of the dust collection opening; a contour shape of the support seat shell is consistent with a contour shape of the fitting opening, the support seat shell is provided with the dust inlets corresponding to the branch areas; an area of the support part between the two adjacent ones of the branch areas and the central area constitutes the avoidance area.

In one embodiment, a press block that extends into the support bottom shell is formed at a bottom of the support seat shell, and at least a portion of a bottom surface of the press block located between the dust inlet and the central area is formed as a curved guide surface gradually extending downward to the central area.

Further, the support bottom shell and the support seat shell are both integrally formed parts, and a portion of the support seat shell is recessed downward to form the press block.

In one embodiment, the dust inlets are arranged on two sides, located in the avoidance area, of a top surface of the support part.

In some embodiments, the top of the support part is provided with a special-shaped baffle for guiding and positioning the cleaning apparatus and the special-shaped baffle is provided corresponding to the avoidance area. The special-shaped baffle includes: two dust cup stoppers which are respectively arranged along the contours of the two dust inlets on the sides away from each other; and an avoidance stopper with two ends coupled to the two dust cup stoppers and arranged along a contour of the avoidance area.

In some embodiments, a motor chamber is defined in the dust collection part. The dust accumulation base includes a suction device arranged in the motor chamber and configured to allow the dust collection chamber to suck dust from the cleaning apparatus through the dust inlet.

In one embodiment, the support part is located above the dust collection part. The dust accumulation base further includes a garbage pipe and the garbage pipe extends in a vertical direction and communicates the dust collection chamber with the dust inlet.

Further, the dust accumulation base further includes: an unlocking member for opening a dust outlet lid on the cleaning apparatus.

In one embodiment, the dust inlet includes a first dust inlet and a second dust inlet that are arranged in parallel, the unlocking member includes two push plates arranged axisymmetrically and respectively provided at an edge of the first dust inlet and an edge of the second dust inlet.

A cleaning apparatus assembly according to an embodiment of the present application includes: a cleaning apparatus including a dust cup component and a body component; and a dust accumulation base which is the dust accumulation base according to the above-mentioned embodiment of the present application, the dust accumulation base being configured to support the cleaning apparatus.

Since the cleaning apparatus assembly according to the embodiment of the present application includes the dust accumulation base, the dust accumulation base can be used to hold the cleaning apparatus, and the dust collection part can be used to collect the dust in the cleaning apparatus, facilitating the dust dumping of the cleaning apparatus and improving the dust dumping effect of the cleaning apparatus.

In one embodiment, the body component has a suction fan wheel that can rotate forward to suck dust, and the cleaning apparatus can discharge dust through the suction fan wheel that rotates backward; or, the dust accumulation base has a suction device, and the suction device performs suction on the dust cup component to suck dust.

In some embodiments, the dust cup component includes a cup body and a cup lid sub-component. The cup lid sub-component includes: a cup lid body arranged on the cup body and able to open and close or fixed on the cup body, the cup lid body being provided with a dust outlet, the dust outlet and the dust inlet being opposite to each other when the cleaning apparatus and the dust accumulation base are fitted in place; and a dust outlet lid arranged on the cup lid body and configured to open and close the dust outlet.

In one embodiment, the cup lid sub-component further includes a locking mechanism arranged between the dust outlet lid and the cup lid body and configured to drive the dust outlet lid to close the dust outlet.

Further, the cup lid body includes an inner lid and an outer lid, the inner lid is fitted on the cup body and provided with the dust outlet, the inner lid is provided with a convex ring surrounding the dust outlet, and the dust outlet lid is fitted on the convex ring; the outer lid is arranged on a side of the inner lid away from the cup body, and the locking mechanism is arranged between the inner lid and the outer lid.

Further, the cleaning apparatus assembly further includes: an unlocking device arranged on at least one of the dust cup component and the dust accumulation base and configured to drive the locking mechanism to unlock and open the dust outlet lid from the dust outlet.

In one embodiment, the locking mechanism includes a slider, a first return member and a second return member, the first return member normally drives the dust outlet lid to move in a direction of closing the dust outlet, and the second return member normally drives the slider to stop the dust outlet lid from moving in a direction of opening the dust outlet lid.

In one embodiment, the dust outlet lid is rotatably coupled to the cup lid body, the first return member normally drives the dust outlet lid to turn over and close the dust outlet, and the slider is adjacent to a side of a rotation shaft of the dust outlet lid, and the second return member is coupled to one end of the slider and normally drives the slider to abut against a side of the dust outlet lid facing the inside of the cup body.

Further, a guide surface is formed on the slider, and the unlocking device extends into a space between the slider and the dust outlet lid along the guide surface so that the slider is separated from the dust outlet lid.

Further, the unlocking device includes an unlocking member arranged on the dust accumulation base, and when the cleaning apparatus and the dust accumulation base are fitted in place, the unlocking member pushes the dust outlet lid to turn over in a direction of opening the dust outlet and pushes the slider to slide in a direction of releasing the dust outlet lid.

In some embodiments, the cleaning apparatus has a main suction channel for air suction to the dust cup component and an air outlet for discharging air. The cleaning apparatus further includes a closing component that closes the main suction channel when triggered. The dust accumulation base is provided with a trigger, and after the dust accumulation base and the cleaning apparatus are fitted in place, the dust inlet is butt-jointed to the dust outlet of the dust cup component, and the trigger triggers the closing component to close the main suction channel.

In one embodiment, the dust cup component has a dust cup inlet. The cleaning apparatus includes an air inlet pipe, one end of the air inlet pipe is configured as a connection opening coupled to the dust cup inlet, and the main suction channel is defined in the air inlet pipe. The closing component extends into a space between the connection opening and the dust cup inlet when triggered.

Further, the cleaning apparatus further includes a first seal member and a second seal member, the first seal member is arranged around the dust cup inlet, the second seal member is arranged around the connection opening, and the closing component extends into a space between the first seal member and the second seal member when triggered.

In some embodiments, a main body of the cleaning apparatus includes the dust cup component and the body component. The cleaning apparatus further includes an accessory detachably coupled to the main body, and the closing component is arranged on the main body.

In one embodiment, the closing component includes: a closing door having a close position for closing the main suction channel and an open position for opening the main suction channel; a normally open return member normally driving the closing door to move toward the open position; and an adjusting member coupled to the closing door, the adjusting member driving the closing door to move when triggered.

Further, the cleaning apparatus includes a protective shell covering an outer side of the main suction channel, an accommodation chamber is defined between the protective shell and the outer wall of the main suction channel, and the closing component is located in the accommodation chamber.

In one embodiment, a sliding groove is formed in the protective shell, and the adjusting member extends out of the cleaning apparatus from the sliding groove.

Further, the closing component includes a guide sheet, the guide sheet is annular or semi-annular and is fitted over the main suction channel, and the closing door is coupled to the guide sheet.

In one embodiment, the dust outlet is located at an axial end of the dust cup component, the closing door can slide in a direction parallel to an axis of the dust cup component, and the normally open return member pushes the closing door toward the dust outlet.

The additional aspects and advantages of the present application will be set forth in part in the following description and become apparent in part from the following description or be understood through the practice of the present application.

BRIEF DESCRIPTION OF THE DRAWINGS

The above-described and/or additional aspects and advantages of the present application will become apparent and readily understood from the description of embodiments in conjunction with the following accompanying drawings, where.

Figure 1:
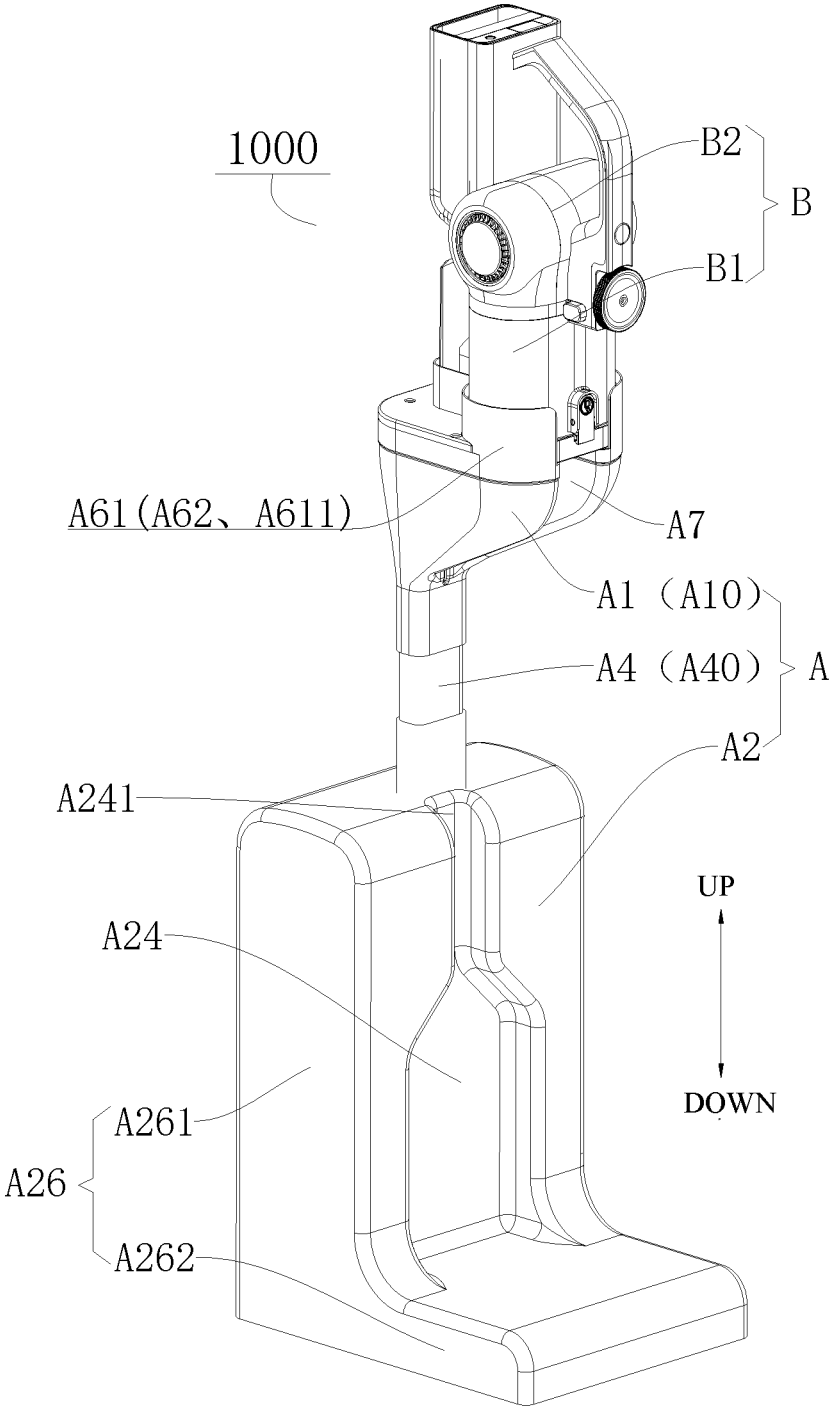
FIG. 1 is a perspective view of a cleaning apparatus assembly according to an embodiment of the present application.

REFERENCE NUMERALS cleaning apparatus assembly 1000;
dust accumulation base A;
dust inlet A01; first dust inlet A011; second dust inlet A012;
support part A1; support sub-part A10; dust passage chamber A11; branch channel A111; gathering chamber A112; first support sub-part A102; second support sub-part A103; sealing groove A14;
support bottom shell A12; fitting opening A121; central area A1211; branch area A1212;
dust collection opening A122;
support seat shell A13; press block A131; curved guide surface A1311;
dust collection part A2; motor chamber A21; air passage hole A211; exhaust hole A212;
dust collection chamber A22; movable buckle A221; dust bag A23; locking plate A231;
avoidance recess A24; avoidance opening A241; storage chamber A25; housing A26; vertical box A261; horizontal seat A262; cover plate A27;
supporting frame A28; switch A29;
suction device A3;
garbage pipe A4; strut A40; first sub-pipe A41; second sub-pipe A42; third sub-pipe A43;
unlocking member A5; push plate A51;

guide member A61; special-shaped baffle A611; dust cup stopper A6111; avoidance stopper A6112; positioning member A62; avoidance area A7; first power port A81, stretchable platform A82, cleaning apparatus B;

main body B0; air inlet pipe B01; main suction channel B011; connection opening B012; air outlet B02;

dust cup component B1; primary separation chamber B101; secondary separation chamber B102;

cup body B11; dust cup inlet B111; cup lid sub-component B12; filter element B13; suction opening B14;

cup lid body B121; dust outlet B1211; inner lid B1212; outer lid B1213; convex ring B1214; dust outlet lid B122; locking mechanism B123;

slider B1231; inclined guide surface B12310; first return member B1232; second return member B1233;

body component B2; motor assembly B21; suction fan wheel B22; second power port B23;

suction accessory B03;

closing component B3;

closing door B31; normally open return member B32; adjusting member B33; guide sheet B34;

first seal member B4; second seal member B5;

protective shell B6; sliding groove B61;

unlocking device C.

DETAILED DESCRIPTION OF THE DISCLOSURE

Embodiments of the present application will be described below in detail. Examples of the embodiments are illustrated in the accompanying drawings, where the same or similar reference numerals throughout the specification refer to the same or similar elements or elements having the same or similar functions. The embodiments described below with reference to the accompanying drawings are exemplary and are intended to be illustrative, but should not be construed as limiting the present application.

The following disclosure provides many different embodiments or examples for implementing different structures of the present application. In order to simplify the disclosure of the present application, the components and settings of specific examples are described below. In one embodiment, they are only examples, and are not intended to limit the present application. In addition, the present application may repeat reference numbers and/or letters in different examples. This repetition is for the purpose of simplification and clarity, and does not in itself indicate the relationship between the various embodiments and/or settings discussed. In addition, the present application provides examples of various specific processes and materials, but the applicability of other processes and/or the use of other materials.

It is found by the inventor in the actual life that the cleaning apparatus in the related art usually requires the user to manually dump the dust, which causes high labor intensity. Moreover, since the cleaning apparatus in the related art is designed to be hand-held and portable and its dust storage space is small, it is inconvenient to go back and forth between a cleaned place and a place where the dust is to be dumped. In addition, there are still some drawbacks in cleaning the dust cup component. For example, hands may get dirty when the user opens a bottom lid of the dust cup. For another example, some dust will be adsorbed on the filter element. Since the dust adsorbed on the filter element cannot be removed when the dust is dumped in a normal way, it is difficult to clean the filter element and the filter element needs to be cleaned subsequently, causing cumbersome operation. Therefore, the present application provides a dust accumulation base and a cleaning apparatus assembly with the same, which can solve at least one of the above problems.

The dust accumulation base A according to the embodiment of the first aspect of the present application will be described below with reference to drawings.

Figure 2:
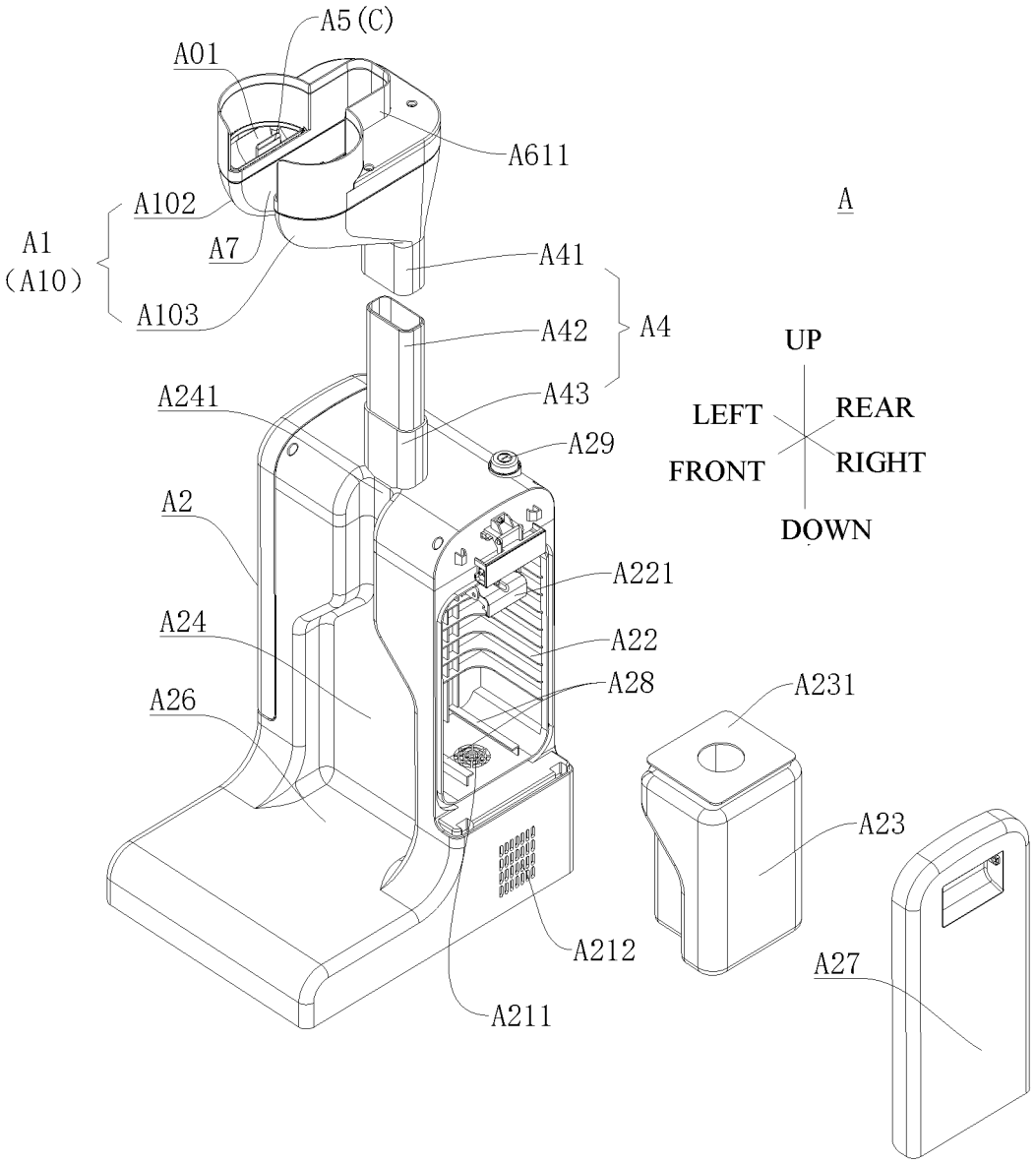
FIG. 2 is an exploded view of a dust accumulation base shown in FIG. 1.

As shown in FIGS. 1 and 2, the dust accumulation base A includes a support part A1 and a dust collection part A2. The support part A1 is configured to support the cleaning apparatus B, and the dust collection part A2 is provided therein with a dust collection part for collecting dust in the cleaning apparatus B. The dust accumulation base A has a dust inlet A01 in communication with the dust collection chamber A22. The support part A1 is configured to support the cleaning apparatus B, and the support part A1 is provided with an avoidance area A7 that can accommodate or avoid a suction accessory B03 of the cleaning apparatus B.

Figure 6:
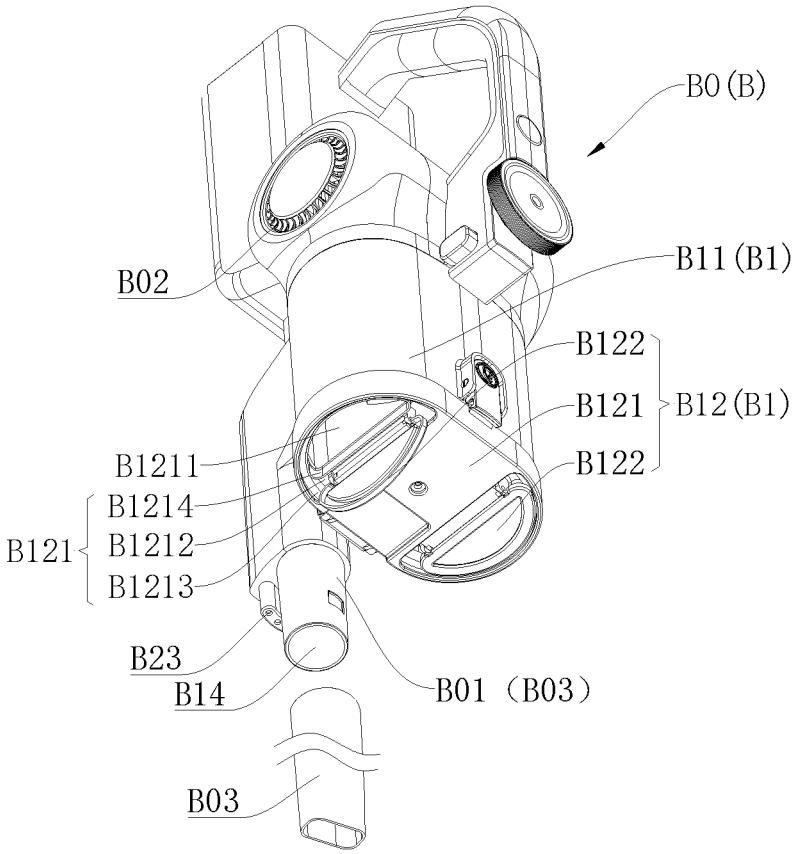
FIG. 6 is a perspective view of a cleaning apparatus shown in FIG. 1.

Therefore, when the cleaning apparatus B is fitted on the dust accumulation base A, the suction accessory B03 can be placed in the avoidance area A7, instead of detaching the suction accessory B03 from the cleaning apparatus B to install the cleaning apparatus B, thus avoiding the process of removing the accessory before the dust is dumped from the cleaning apparatus. In some embodiments, the suction accessory B03 on the cleaning apparatus B is not detachable. For example, in the example of FIG. 6, a main body B0 of the cleaning apparatus B has an air inlet pipe 01, and the air inlet pipe 01 is not removable. The air inlet pipe 01 can be placed in the avoidance area A7, so that the main body B0 can be securely fitted on the support part A1. In the example of FIG. 6, the cleaning apparatus B further includes another suction accessory B03 detachably coupled to the main body B0, for example, the suction accessory B03 can be inserted in and coupled to the air inlet pipe 01; the suction accessory B03 is long, and the top of the suction accessory B03 can also be placed in the avoidance area A7.

Since the suction accessory B03 is placed in the avoidance area A7, instead of being hung outside the support part A1, a case where the whole apparatus is not stable when the dust is dumped due to the external suspension of the suction accessory B03 can be avoided. In this way, the stability and safety of the cleaning apparatus B supported by the dust accumulation base A can be improved.

Moreover, because the cleaning apparatus B is mainly supported by the support part A1, and the avoidance area A7 is configured to avoid the suction accessory B03, the avoidance area A7 will not affect the stability of the cleaning apparatus B, that is, the cleaning apparatus B can be installed steadily when the suction accessory B03 is not removed and when the suction accessory B03 is removed. Therefore, the user can directly fit the cleaning apparatus B on the dust accumulation base A after use, without having to consider whether to install or remove a certain suction accessory.

In addition, since the dust accumulation base A can stably support the cleaning apparatus B, the user can fit the cleaning apparatus B on the dust accumulation base A after using the cleaning apparatus B. The dust accumulation base A is both a place for collecting dust for the cleaning apparatus B and a place for storing the cleaning apparatus B. The dust can be removed immediately every time the cleaning apparatus B is stored in the dust accumulation base, avoiding a case where the user forgets to dump the dust after using the cleaning apparatus B. In this way, the user avoids the trouble of dumping the dust before using the cleaning apparatus B next time.

It should be noted that the type of the cleaning apparatus B according to the embodiment of the present application is not limited, for example, it can be a hand-held vacuum cleaner, a hand-held push-rod vacuum cleaner, a mopping vacuum cleaner, or the like. After the type of cleaning apparatus B is determined, the types of the suction accessory B03 of the cleaning apparatus B.

For example, when the cleaning apparatus B is a hand-held push-rod vacuum cleaner, the cleaning apparatus B may include a push rod (not shown in the figure), a floor brush (not shown in the figure), and the like in addition to the dust cup component B1. For another example, when the cleaning apparatus B is a mopping vacuum cleaner, the cleaning apparatus B may include a hose (not shown in the figure), a floor brush (not shown in the figure), and the like in addition to the dust cup component B1. In addition, according to different cleaning goals, different cleaning apparatuses B use different suction accessories B03, including straight pipe heads, hose heads, brush heads, and the like; therefore, the specific shape of the dust accumulation base A should also be adapted to the type of cleaning apparatus B.

Therefore, in the dust accumulation base A according to the embodiment of the present application, the support part A1 can be configured to hold the cleaning apparatus B and the dust collection part A2 can be configured to collect dust in the cleaning apparatus B, thus achieving powerful functions. When the dust storage space in the cleaning apparatus B is small, the user can place the dust accumulation base A closer to the cleaned place, so that the cleaning apparatus B can dump dust in the dust accumulation base A at any time, preventing the user from repeatedly going back and forth to the indoor dust dumping place (such as a bathroom, a kitchen or the like in a house), and reducing the user's labor intensity.

In some embodiments, due to the structure of the filter element B13 in the cleaning apparatus B, wire entangling hardly occurs; or the environment where the cleaning apparatus B is used basically has granular and flocculent dust but has less hair and silk trash. For those cleaning apparatuses B, dust can be dumped very simply. The cleaning apparatus B is fitted on the dust accumulation base A, and after the dust outlet B1211 of the cleaning apparatus B and the dust inlet A01 of the dust accumulation base A are fitted in place, the dust in the cleaning apparatus B can be directly affected by gravity and dumped out. Sometimes, by knocking the dust cup component B1, the dust dumping effect can be improved.

Figure 3:
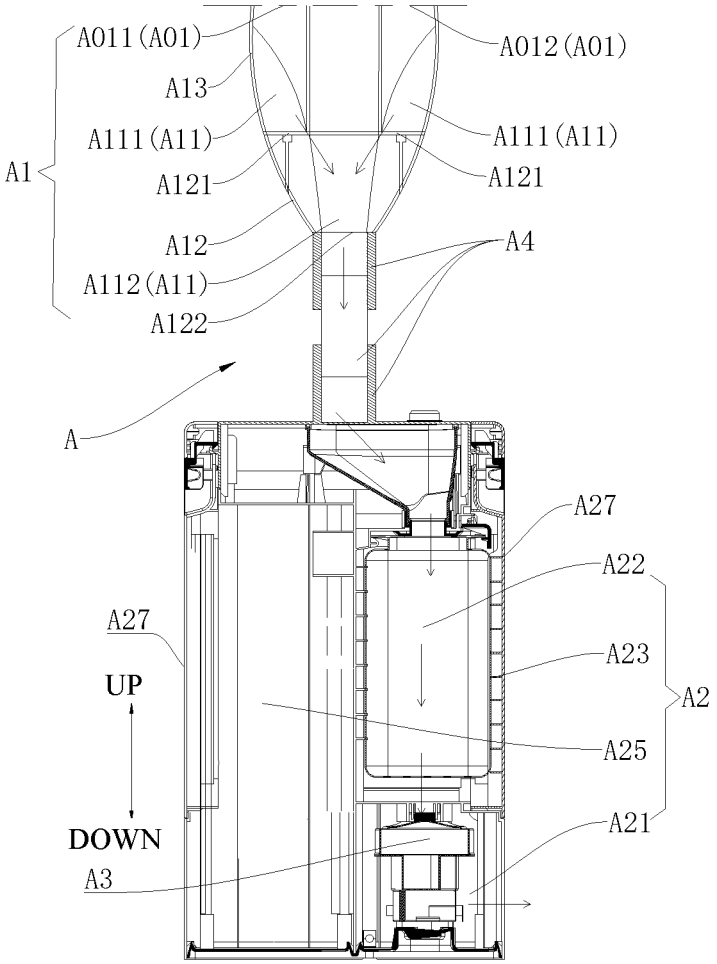
FIG. 3 is a cross-sectional view of the dust accumulation base shown in FIG. 2.

In other embodiments, as shown in FIG. 3, the dust collection part A2 also has a motor chamber A21, and the dust accumulation base A further includes a suction device A3 arranged in the motor chamber A21. The suction device A3 is configured to cause the dust collection chamber A22 to suck the dust from the cleaning apparatus B; that is, after the suction device A3 is started, negative pressure can be generated in the dust collection chamber A22, and the dust in the cleaning apparatus B can be sucked in. Under the action of the suction device A3, the dust in the cleaning apparatus B can be sucked into the dust collection chamber A22 more effectively and quickly, improving the dust removal rate of the filter element B13 in the cleaning apparatus B, improving the overall dust dumping effect of the cleaning apparatus B, avoiding separate cleaning of the filter element B13 by the user, and greatly reducing the user's labor intensity.

Therefore, in the dust accumulation base A according to the embodiment of the present application, the support part A1 can be configured to hold the cleaning apparatus B and the dust collection part A2 and the suction device A3 can be configured to collect dust in the cleaning apparatus B, thus achieving powerful functions. Moreover, under the action of the suction device A3, the dust in the cleaning apparatus B can be sucked into the dust collection chamber A22 more effectively and quickly, improving the dust removal rate of the filter element B13 in the cleaning apparatus B, improving the overall dust dumping effect of the cleaning apparatus B, avoiding separate cleaning of the filter element B13 by the user, and greatly reducing the user's labor intensity.

In addition, when the dust storage space in the cleaning apparatus B is small, the user can place the dust accumulation base A closer to the cleaned place, so that the cleaning apparatus B can dump dust in the dust accumulation base A at any time, preventing the user from repeatedly going back and forth to the indoor dust dumping place (such as a bathroom, a kitchen or the like in a house) and reducing the user's labor intensity.

It can be understood that the specific structure and working principle of the suction device A3; for example, the suction device A3 may be configured as a fan with a motor, a vacuum pump or the like, which will not be repeated here. In addition, in order to realize the communication between the motor chamber A21 and the dust collection chamber A22, a chamber wall of the motor chamber A21 has an air passage hole A211. In order to ensure the normal operation of the suction device A3, since the chamber wall of the motor chamber A21 has an exhaust hole A212, the dust chamber A22 can suck dirty air in when the suction device A3 is working. Clean air separated in the dust chamber A22 can enter the motor chamber A21 through the air passage hole A211, and then be discharged out of the motor chamber A21 through the exhaust hole A212.

In other embodiments, the cleaning apparatus B can also be configured to blow air to the dust accumulation base A, so that the dust in the cleaning apparatus B can also be brought into the dust collection chamber A22 when the air flows from the cleaning apparatus B to the dust collection chamber A22.

In some embodiments, as shown in FIG. 1, the support part A1 is coupled to the dust collection part A2 through a strut A40; that is, the support part A1 is supported by the dust collection part A2. Therefore, when the cleaning apparatus B is fitted on the support part A1, the dust collection part A2 has to bear both the weight of the dust accumulation base A and the weight of the cleaning apparatus B. Therefore, one of the key points of the design of this structure is to ensure that the structure layout of the dust accumulation base A is reasonable, to avoid the unbalance of the center of gravity after the cleaning apparatus B is fitted.

In some embodiments, the support part A1 and the dust collection part A2 are separate parts, and the support part A1 is fixed to an external object by a supporting and fixing assembly (not shown in the figure). The external object here can be a building wall, a desk, a cabinet or other objects. The supporting and fixing assembly may be configured as a screw fastening structure, an adhesive structure, a suction cup structure, or the like, and the structural form of the support part A1 fixed to an external object is not limited here.

When the support part A1 is coupled to the dust collection part A2 through the strut A40, in some specific examples, as shown in FIG. 2, the support part A1 and the dust collection part A2 are detachably connected through the strut A40. In this way, the support part A1 and the dust collection part A2 are split into two parts at the strut 40, facilitating the storage, packaging and transportation of the dust accumulation base A. In some examples, the dust collection part A2 is provided with a storage chamber for accommodating the support part A1, and the support part A1 is taken out and installed during use. Here, it should be noted that the specific structure of the strut 40 is not limited as long as the support part A1 and the dust collection part A2 are detachably connected.

In some other examples, the support part A1 and the dust collection part A2 are connected by the strut A40 in an adjustable distance, so that the strut A40 can be adjusted to better meet the needs of the storage of the suction accessory B03 when the suction accessory B03 on the cleaning apparatus B is too long or too short. For example, the strut A40 is configured as a soft rod. When the support part A1 is fixed to the external object by the supporting and fixing assembly, the soft rod can be adjusted by way of stretching out and retracting through the fixed position of the support part A1. For another example, the strut A40 may also be a rigid rod. After being adjusted by way of stretching out and retracting, the strut A40 is locked by a locking structure, and there is no limitation for this here.

In other examples, the strut A40 can be adjusted in height and can be detached. Since the strut can be disassembled and assembled, and also can be adjusted in height as required, better use convenience can be achieved.

In some embodiments, as shown in FIGS. 2 and 3, the dust inlet A01 may be formed in the support part A1, and the support part A1 has a dust passage chamber A11 communicating the dust inlet A01 with the dust collection chamber A22. Therefore, the dust collection part A2 can suck the dust from the cleaning apparatus B through the dust inlet A01 and the dust passage chamber A11 in the support part A1, so that the support part A1 can be used for not only supporting the cleaning apparatus B, but also sucking dust. In this way, the structure of the dust accumulation base A becomes more compact and smaller. In one embodiment, the present application is not limited to this, and the dust inlet A01 is not limited to being formed on the support part A1. For example, the dust inlet A01 may also be arranged on the dust collection part A2, which will not be detailed here.

In one embodiment, the support part A1 includes support sub-parts A10 for supporting the cleaning apparatus B, and an avoidance area A7 is defined between at least two support sub-parts A10. The avoidance area A7 is open on one horizontal side (i.e., a side in a horizontal direction; e.g., the front side shown in FIG. 2) and on two vertical sides (i.e., two sides in a vertical direction; e.g., the upper and lower sides in FIG. 2) respectively to avoid the suction accessory B03 of the cleaning apparatus B. In this way, the cleaning apparatus B can be supported by at least two support sub-parts A10 on the two horizontal sides of the avoidance area A7, thus realizing more stable supporting.

In one embodiment, in the embodiments of the present application, the shape of the avoidance area A7 is not limited to this, and the avoidance area A7 can also be formed as a groove in the center of the support part A1, or the avoidance area A7 is open on two horizontal sides.

In one embodiment, the top surface of the support part A1 is provided with dust inlets A01 on two sides of the avoidance area A7. In one embodiment, the top surface of each support sub-part A10 is provided with a dust inlet A01, and the top surface of the support sub-part A10 is configured to position the end surface of the dust cup component B1. In this way, the cleaning apparatus B can be positioned and conduct dust cleaning no matter on which support sub-part A10 the cleaning apparatus B is fitted. Here, a surface shape adapted to the end surface of the dust cup component B1 is formed on the top surface of the support sub-part A10, and the dust cup component B1 can be positioned to a certain extent through surface fitting, which is beneficial to the quick alignment and connection of the dust inlet A01 and the dust outlet B1211 and avoids dust leakage caused by tilting.

In one embodiment, as shown in FIG. 1, the support part A1 may be located above the dust collection part A2, and the dust accumulation base A may also include a garbage pipe A4. In conjunction with FIG. 3, the garbage pipe A4 extends vertically and communicates the dust collection chamber A22 with the dust passage chamber A11, and thus the dust in the dust passage chamber A11 can be supplied to the dust collection chamber A22 through the garbage pipe A4. Thus, by arranging the support part A1 above the dust collection part A2, and connecting the support part A1 to the dust collection part A2 through the garbage pipe A4 extending in the vertical direction, the support part A1 can supply dust to the dust collection part A2 and the height of the support part A1 can be increased so that the user can place the cleaning apparatus B on the support part A1 without bending over.

In some embodiments, as shown in FIGS. 2 and 3, the support part A1 and the dust collection part A2 may be detachably connected through the garbage pipe A4. The support part A1 and the dust collection part A2 can be split into two parts from the garbage pipe A4, thus facilitating the storage, packaging and transportation of the dust accumulation base A. Here, it should be noted that the specific structural form of the garbage pipe A4 is not limited as long as the support part A1 and the dust collection part A2 can be detachedly connected.

For example, in the example shown in FIG. 2, the garbage pipe A4 may include a first sub-pipe A41, a second sub-pipe A42, and a third sub-pipe A43 that are sequentially connected from top to bottom. The first sub-pipe A41 can be integrated with the support part A1, the third sub-pipe A43 can be integrated with the dust collection part A2, and the second sub-pipe A42 can be inserted in the first sub-pipe A41 and the third sub-pipe A43 respectively. Therefore, the support part A1 and the dust collection part A2 can be detachably connected through the garbage pipe A4 in a simple and effective manner.

In one embodiment, the structure of the garbage pipe A4 is not limited to this. For example, in other embodiments, the second sub-pipe A42 can also be omitted, and the first sub-pipe A41 and the third sub-pipe A43 can be directly connected in an inserting way. In addition, in other embodiments of the present application, the garbage pipe A4 can also be configured as a stretchable sleeve structure, so that the height of the support part A1 can be changed by adjusting the length of the garbage pipe A4, to better meet the actual needs of users of different heights.

In some embodiments, as shown in FIG. 2, the support part A1 may include a first support sub-part A102 and a second support sub-part A103, and the avoidance area A7 which is open on a horizontal side (i.e., a side in a horizontal direction; e.g., the front side shown in FIG. 2) and on two vertical sides (i.e., two sides in a vertical direction; e.g., the upper side and lower side in FIG. 2) is defined between the first support sub-part A102 and the second support sub-part A103.

In one embodiment, in other embodiments, the support part A1 may also include more support sub-parts A10, and support sub-parts A10 are coupled to form a support part A1. Among the multiple support sub-parts A10, the avoidance area A7 can be formed between two suitable support sub-parts A10, and one avoidance area A7 or multiple avoidance areas A7 may be formed.

In some embodiments, as shown in FIG. 2, when the support part A1 is located above the dust collection part A2 and the support part A1 has the avoidance area A7, the dust collection part A2 may also have an avoidance recess A24, and the avoidance recess A24 is configured to avoid a downwardly extending push rod, a floor brush and other suction accessories B03; therefore, there is no need to deliberately configure the dust collection part A2 as a thin box shape as a whole in order to avoid the suction accessory B03. Therefore, by providing the avoidance recess A24 on the dust collection part A2, the dust collection part A2 can be configured in any shape as required, to ensure that the dust collection part A2 can be stably supported on the ground on the one hand and that the dust collection part A2 has a dust collection chamber A22 with sufficient capacity on the other hand.

In one embodiment, as shown in FIG. 2, the avoidance recess A24 is arranged on the side wall of the dust collection part A2 to avoid the suction accessory B03 having a long tube and a long brush head. Here, since the avoidance recess A24 is formed on the side wall of the dust collection part A2, the portion of the dust collection part A2 with the avoidance recess A24 is thin, and the portion of the dust collection part A2 without the avoidance recess A24 is thick. In this way, the case where the dust collection part A2 is relatively thick as a whole and thus occupies too much space can be avoided on the one hand, and the avoidance recess A24 can form a certain limit for the suction accessory B03 on the other hand.

In one embodiment, as shown in FIG. 2, the avoidance recess A24 is narrow at the top and wide at the bottom, and the avoidance recess A24 is provided with an upwardly penetrating avoidance opening A241 corresponding to the avoidance area A7. Here, due to arrangement of the avoidance opening A241, the long tube can extend into the avoidance recess A24 conveniently. The avoidance recess A24 is formed into a shape with a narrow top and a wide bottom, so that the avoidance recess A24 can position the suction accessory B03 (such as a brush head) with a wide end. In this way, the avoidance recess A24 can position more types of accessories.

In some embodiments, as shown in FIG. 1, a housing A26 of the dust collection part A2 includes: a vertical box A261 and a horizontal seat A262. The vertical box A261 is arranged vertically and having a front surface and two side surfaces. The front surface of the vertical box A261 is wider than the side surface of the vertical box A261. The avoidance recess A24 is formed in the front surface of the vertical box A261. The horizontal seat is horizontally coupled to a bottom of the vertical box A261. The vertical box body 261 is shaped to be generally flat relatively, and the arrangement of the horizontal seat A262 is beneficial to increasing a contact area with the ground to improve the stability under the premise of ensuring the flatness of the upper part.

In one embodiment, a bottom surface of the avoidance recess A24 is flush with an upper surface of the horizontal seat A262, or the bottom surface of the avoidance recess A24 and the upper surface of the horizontal seat A24 are connected in an arc transition. In this way, the inhalation attachment B03 with a wide end can be fitted in the avoidance recess A24 more conveniently and locked more easily.

Figure 4:
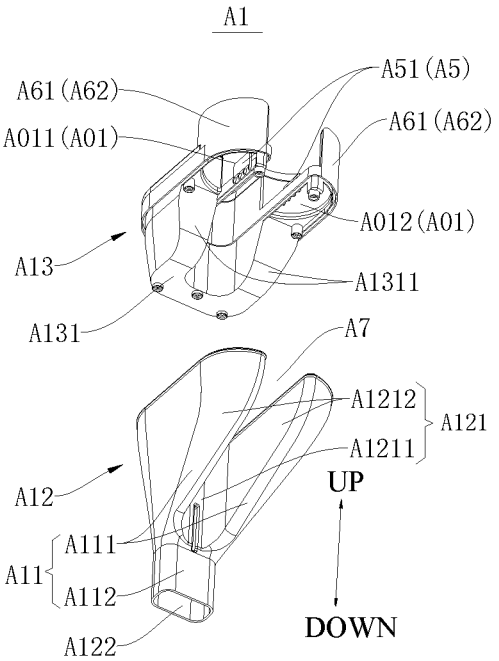
FIG. 4 is an exploded view of a support part shown in FIG. 2.

In some embodiments, as shown in FIGS. 3 and 4, the dust inlet A01 may include a first dust inlet A011 and a second dust inlet A012 that are arranged in parallel, that is, when the suction device A3 is working, the first dust inlet A011 and the second dust inlet A012 can simultaneously suck dust from the cleaning apparatus B. The first dust inlet A011 may be formed in the top surface of the first support sub-part A102, the second dust inlet A012 may be formed in the top surface of the second support sub-part A103, and the support part A1 is provided therein with a dust passage chamber in communication with the first dust inlet A011, the second dust inlet A012 and the dust collection chamber A22.

Therefore, the dust collection part A2 can suck the dust from the cleaning apparatus B through the first dust inlet A011, the second dust inlet A012 and the dust passage chamber A11 in the support part A1, so that the support part A1 can be used for not only supporting the cleaning apparatus B, but also sucking dust. In this way, the structure of the dust accumulation base A becomes more compact. Moreover, since the support part A1 has two dust inlets A01, the dust suction speed can also be increased and the waiting time of the user can be reduced.

In addition, it is worth noting that the number of dust passage chambers A11 is not limited. For example, the dust passage chamber A11 may be formed as an integral chamber coming into communication with the first dust inlet A011 and the second dust inlet A012 at the same time. For another example, there may be two dust passage chambers A11 arranged in parallel, one of the dust passage chambers A11 is arranged between and comes into communication with the first dust inlet A011 and the dust collection chamber A22, and the other dust passage chamber A11 is arranged between and comes into communication with the second dust inlet A012 and the dust collection chamber A22.

In some embodiments, as shown in FIGS. 3 and 4, a dust passage chamber A11 is defined in the dust accumulation base A and includes a gathering chamber A112 and branch channels A111. One ends of the branch channels A111 are respectively coupled to the dust inlets A01, and the other ends of the branch channels A111 are both in communication with the gathering chamber A112. A bottom of the gathering chamber A112 is provided with a dust collection opening A122. Here, the branch channel A111 is correspondingly coupled to the dust inlet A01 to guide the dust entering from the dust inlet A01. It should be noted here that one or more branch channels A111 may be provided. In the case of one branch channel A111, it corresponds to a solution of one dust inlet A01. In the case of multiple branch channels A111, it corresponds to the solution of multiple dust inlets A01. Each branch channel A111 corresponds to a dust inlet A01.

In some examples, two dust inlets A01 are symmetrically arranged on the dust accumulation base A, and each dust inlet A01 is respectively in communication with a branch channel A111, and the ends of the two branch channels A111 are both in communication with the gathering chamber A112.

It can be seen from the above structure that the dust accumulation base A of the embodiment of the present application adopts a structure having multiple dust inlets A01 and multiple branch channels A111 which are in a one-to-one correspondence. When the cleaning apparatus B is coupled to the dust accumulation base A, the multiple dust outlets B1211 on the cleaning apparatus B are butt-jointed to the dust inlets A01 on the dust accumulation base A, and then the dust collected in the cleaning apparatus B can be discharged from the multiple dust inlets A01 down to the dust accumulation base A. Based on the design of multiple dust inlets A01, in the case of multiple dust outlets B1211 on the cleaning apparatus B, dust can be dumped from the multiple dust outlets B1211 at the same time, not one by one. In this way, the dust dumping time can be shortened greatly, and the user can dump dust from the multiple dust outlets B1211 at the same time, thus reducing the cleaning workload.

Due to adoption of a structure having one dust inlet A01 and multiple branch channels A111, when the cleaning apparatus B is coupled to the dust accumulation base A, the multiple dust outlets B1211 on the cleaning apparatus B are all butt-jointed to the dust inlets A01 below. In this way, the structure of the dust inlet A01 is simple, the design of the specific position of the dust outlet B1211 on the cleaning apparatus B is less restricted, and thus the overall processing of the dust accumulation base A and the cleaning apparatus B is simple.

In addition, when the dust outlets B1211 with multiple dust chamber separation chambers are formed in the cleaning apparatus, the dust outlet B1211 that needs to be emptied can be selected according to the amount of dust collected in the dust chamber separation chambers, and accordingly the corresponding dust outlet B1211 and dust inlet A01 come into communication for targeted emptying.

In the present application, the dust entering from the dust inlet A01 is gradually sent into the gathering chamber A112 under the guidance of the branch channel A111; that is, the dust dumped from the dust inlet A01 is split and guided into the gathering chamber A112, and dust raising will not occur in this process. The dust in the multiple branch channels A111 is gathered in the gathering chamber A112 and is discharged from the dust collection opening A122 to the subsequent components, thus achieving high dust accumulation efficiency. The dust collected at the dust collection opening A122 can be introduced in a dust treatment component or dust collecting component for centralized treatment.

It can be understood that when multiple dust inlets A01 and multiple branch channels A111 are designed at the same time, the dust can be discharged and guided quickly, and dust raising will not occur. Compared a structure with the dust collection chamber but no branch channel, the structure of the present application has various forms and is more intensive and more compact.

In the following, the structure having multiple dust inlets A01, multiple dust outlets B1211 multiple branch channels A111 are described.

In some embodiments of the present application, as shown in FIGS. 3 and 4, in a direction from the dust inlet A01 to the gathering chamber A112, the flow area of each branch channel A111 gradually decreases. Therefore, the branch channel A111 has a large dust feeding inlet but a small dust passage outlet. On the one hand, the cross-section of the branch channel A111 gradually changes to form a funnel shape to facilitate diversion, the dust raising is reduced during the gradual accumulation of dust and dust collection is facilitated; on the other hand, due to this arrangement, the outline of the dust accumulation base at the corresponding branch channel A111 gradually decreases in size, which is beneficial to reduction of the thickness of the whole machine.

As shown in FIG. 4, the gathering chamber A112 is located below the dust inlet A01, and the horizontal projections of the dust inlet A01 and the gathering chamber A112 do not overlap. Each branch channel A111 is a curved channel. Here, the dust entering from the dust inlet A01 will not fall straight into the gathering chamber A112, but will pass through the middle curved branch channel A111 curve to be cushioned and guided and then gathered into the gathering chamber A112, which can effectively reduce the upwelling of dust. In addition, the staggered arrangement between the dust inlet A01 and the gathering chamber A112 facilitates the arrangement of the support part A1 (the structure of the support part A1 is described later), so that the support part A1 has more space arrangement possibilities when coupled to other components.

In one embodiment, the horizontal projections of the multiple dust inlets A01 are arranged around the horizontal projection of the gathering chamber A112. When the dust inlets A01 surround the gathering chamber A112, dust can quickly enter the gathering chamber A112 from each dust inlet A01, and the branch channels A111 are also easy to arrange, the branch channels A111 can be easily formed as components with similar dimensions and similar connecting structures. The processing is easy, and the layout is more reasonable and more compact.

Advantageously, the horizontal projection of each dust inlet A01 is evenly spaced around the center of the horizontal projection of the collection chamber A112, which facilitates the arrangement of the branch channel A111 and realizes the quick dust guide.

In some embodiments, as shown in FIGS. 3 and 4, the supporting portion A1 includes a support bottom shell A12 and a support seat shell A13.

In one embodiment, as shown in FIGS. 3 and 4, the top of the support bottom shell A12 is open to form a fitting opening A121, and a dust collection opening A122 is formed at the bottom of the support bottom shell A12. It should be noted that FIG. 4 does not show the opening (i.e., the fitting opening) at the top of the support bottom shell A12 for the reason of the viewing angle; however, it should be understood that tops at the positions quoted by reference numerals A121, A1211 and A1212 in FIG. 4 are open and correspond to the fitting opening, the central area and the branch area mentioned below, respectively.

The support seat shell A13 is fitted on the fitting opening A121, and the dust inlet A01 is formed on the support seat shell A13. By arranging the support part A1 as two parts (i.e., the support bottom shell A12 and the support seat shell A13), the support seat shell A13 is formed as a structure that is more conducive to supporting the cleaning apparatus B, so that the cleaning apparatus B can be connected conveniently; and the support bottom shell A12 is formed as a structure for dust passage and dust collection, so that it is more easier to separately machine and manufacture various components of the support part A1 according to their respective functional features. In one embodiment, the support bottom shell A12 and the support seat shell A13 are respectively integral injection molded parts, and the separate machining of the support bottom shell A12 and the support seat shell A13 is beneficial to mold release.

In one embodiment, as shown in FIG. 3, a dust passage chamber A11 is defined between the support seat shell A13 and the support bottom shell A12. When the support seat shell A13 is butt-jointed to the support bottom shell A12 through the fitting opening A121, a through dust passage chamber A11 is formed. The dust inlet A01 and the dust collection opening A122 are respectively formed at two ends of the dust passage chamber A11.

In one embodiment, as shown in FIG. 4, the fitting opening A121 includes a central area A1211 and branch areas A1212, one ends of branch areas A1212 respectively extend to the central area A1211, so that a contour line of the fitting opening A121 is a single closed loop. As mentioned here that the contour line of the fitting opening A121 is a single closed loop, it emphasizes that the central area A1211 and branch areas A1212 refer to different areas of the same opening. Dividing the fitting opening A121 into a central area A1211 and branch areas A1212 is only for the convenience of describing the detailed structure of the support part A1 later. The fitting opening A121 is shaped like a flower, branch areas A1212 are equivalent to petals.

When the support seat shell A13 and the support bottom shell A12 are butt-jointed through the fitting opening A121, the fitting opening A121 is formed as a single closed loop so that the support bottom shell can be machined and formed easily. In addition, a certain guiding and positioning effect is achieved when the support bottom shell A12 and the support seat shell A13 are butt-jointed, so that the support seat shell A13 keeps stable and does not wobble after being quickly installed on the support bottom shell A12.

Further, referring to FIG. 4, the dust collection opening A122 is located below the central area A1211. The area of the dust collection opening A122 is much smaller than that of the fitting opening A121, and it is mainly concentrated under the central area A1211. In this way, the curvature of the shell wall of the support bottom shell A12 will not be too large, which is convenient for machining.

In one embodiment, the shape of the dust collection opening A122 is consistent with the shape of the central area A1211; for example, the central area A1211 is square, the dust collection opening A122 is square too. In some examples, the shape of the dust collection opening A122 is not consistent with the shape of the central area A1211, for example, the central area A1211 is square, but the dust collection opening A122 is circular.

Advantageously, as shown in FIG. 4, the support bottom shell A122 is shaped by gradually changing downward from a contour of the fitting opening A121 to a contour of the dust collection opening A122. The support bottom shell A12 is substantially formed into a shape with an upper top and a small bottom. On the one hand, the contour of the support bottom shell A12 gradually changes downward to form a funnel shape to facilitate diversion, the dust raising is reduced during the gradual accumulation of dust and dust collection is facilitated; on the other hand, the outline of the support bottom shell A12 gradually decreases in size and thus the support part A1 is more intensive and more compact.

In one embodiment, as shown in FIG. 4, the contour shape of the support seat shell A13 is consistent with the contour shape of the fitting opening A121, and the support seat shell A13 is provided with a dust inlet A01 corresponding to the branch area A1212. Based on the above structure, on the one hand, the positioning and assembly of the support seat shell A13 and the support bottom shell A12 are facilitated, and on the other hand, the fitting opening A121 can be conveniently sealed completely, only the dust inlet A01 is open to for suck dust.

After the support seat shell A13 is coupled to the support bottom shell A12, they are in seamless connection and do not wobble, and moreover, the dust inlet A01 is aligned with the branch area A1212; the cleaning apparatus B is stably supported after being fitted on the support seat shell, and the effect of rapid dust discharge is also achieved.

In one embodiment, as shown in FIG. 4, the area on the support part A1 between the two adjacent branch areas A1212 and the central area A1211 constitutes an avoidance area A7. The avoidance area A7 is formed inside the support part A1 to accommodate the suction accessory B03 on the cleaning apparatus B, such as a push rod, a floor brush, or the like, so that the cleaning apparatus B can be directly placed on the support A1 without detaching the accessory, which is convenient for operation and beneficial to use.

In the example of FIGS. 3 and 4, the dust inlet A01 includes a first dust inlet A011 and a second dust inlet A012 that are arranged in parallel. The first dust inlet A011 and the second dust inlet A012 can simultaneously suck dust from the cleaning apparatus B. The first dust inlet A011 and the second dust inlet A012 are respectively formed on the top surface of the support seat shell A13, and the first dust inlet A011 and the second dust inlet A012 respectively come into communication with a branch area A1212. In this example, one avoidance area A7 is provided, and the structure of the dust accumulation base A is compact and small structure and dust can be sucked in quickly.

Further, as shown in FIG. 4, a press block A131 extending into the support bottom shell A12 is formed at the bottom of the support seat shell. In the bottom surface of the press block A131, at least a portion of the bottom surface between the dust inlet A01 and the central area A1211 is formed as a curved guide surface A1311 that gradually extends downward to the central area A1211. The curved guide surface A1311 of the press block A131 forms the top surface of the branch channel A111, which further improves the guiding effect of the branch channel A111.

In one embodiment, the support bottom shell A12 is an integrally formed part, and the support seat shell A13 is also an integrally formed part. A portion of the support seat shell A13 is recessed downward to form the press block A131. The press block A131 is added with a fitting surface between the support bottom shell A12 and the support seat shell A13. Here, the support bottom shell A12 and the support seat shell A13 are respectively arranged as integral parts to facilitate the machining of the support bottom shell A12 and the support seat shell A13, and the press block A131 is formed by a portion of the support seat shell A13 recessed downward. In this way, the weight of the support seat shell A13 is reduced greatly.

In one embodiment, the support seat shell A13 and the support bottom shell A12 in the present application may also be of an integrally formed structure; that is, in the case of the above-mentioned contour shape, the dust inlet A01 and the dust collection opening A122, the support seat shell A13 and the support bottom shell A12 are formed as an integrally formed structure, and a fitting opening A121 is not required.

Figure 5:
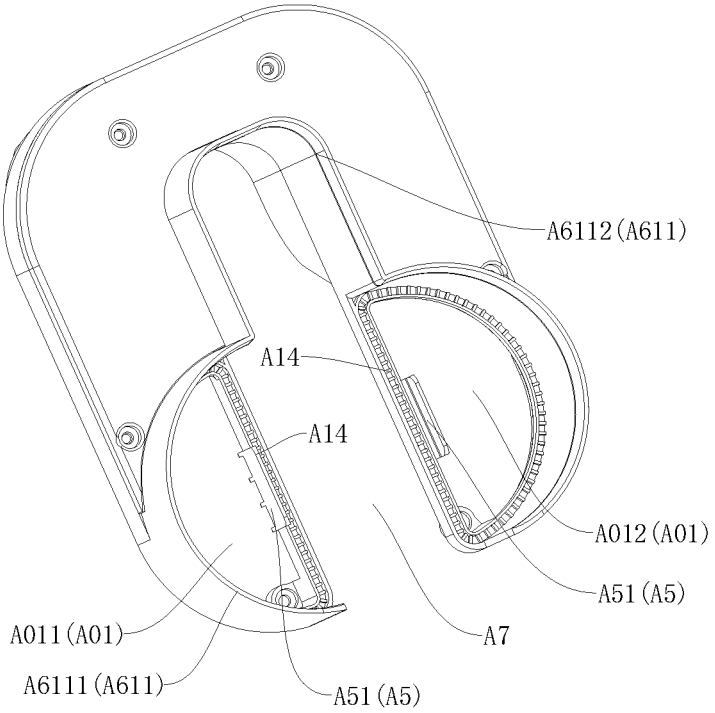
FIG. 5 is an assembly diagram of the support part shown in FIG. 4.

In some embodiments, as shown in FIGS. 4 and 5, the dust accumulation base A may further include an unlocking member A5 configured to open a dust outlet lid B122 on the cleaning apparatus B (in conjunction with FIG. 6). Therefore, when the cleaning apparatus B is placed on the dust accumulation base A, the unlocking member A5 on the dust accumulation base A can be configured to open the dust outlet lid B122 on the cleaning apparatus B so that the dust inlet A01 on the dust accumulation base A comes into butt-jointed connection with the dust outlet B1211 on the cleaning apparatus B; in this way, the user does not need to manually operate the dust outlet lid B122, avoiding the user from getting his hands dirty and reducing the user's labor intensity.

In some embodiments, a closable dust outlet lid B122 is arranged at each dust outlet B1211, each dust outlet B1211 corresponds to a dust inlet A01, and the unlocking member A5 is formed as push plates A51 which are respectively arranged on edges of multiple dust inlets A01. The unlocking member A5 has simple structure and is convenient to machine and manufacture, and push plates A51 can also act on the cleaning apparatus B at the same time to open the multiple dust outlet lids B122 (in conjunction with FIG. 6) at the same time, improving the dust dumping efficiency. In one embodiment, the push plates A51 are symmetrically arranged on the edges of the dust inlets A01 to avoid interference of the push plates A51 during work and facilitate machining.

As shown in FIGS. 4 and 5, the dust inlet A01 includes a first dust inlet A011 and a second dust inlet A012 that are arranged in parallel. The unlocking member A5 includes two push plates A51 arranged axisymmetrically and arranged on an edge of the first dust inlet A011 and an edge of the second dust inlet A012. Therefore, the unlocking member A5 has simple structure and is convenient to machine and manufacture, and the two push plates A51 can also act on the cleaning apparatus B at the same time to open the two dust outlet lids B122 ((in conjunction with FIG. 6), improving the dust dumping efficiency. In addition, by arranging the two push plates A51 axisymmetrically, the actions of the two push plates A51 can also be prevented from interfering with each other.

In some embodiments, as shown in FIGS. 1 and 2, the dust accumulation base A may include a guide member A61 configured to guide the cleaning apparatus B. Therefore, the guide member A61 can be configured to quickly align the cleaning apparatus B to the dust accumulation base A and assemble the cleaning apparatus B and the dust accumulation base A in place, improving the accuracy of the butting between the dust outlet B1211 of the cleaning apparatus B and the dust inlet A01 of the dust accumulation base A and ensuring smooth running of dust.

In some embodiments, as shown in FIGS. 1 and 2, the dust accumulation base A may include a positioning member A62 configured to position the cleaning apparatus B. Therefore, the relative position between the cleaning apparatus B and the support part A1 can be fixed by the positioning member A62, the user's hands can be released, and the user can leave the cleaning apparatus B alone on the dust accumulation base A, and then leave to do other things.

In some embodiments, a positioning member A62 and a guide member A61 are arranged on the dust accumulation base A at the same time. It is worth noting that the specific structural forms of the guide member A61 and the positioning member A62 are not limited, as long as the above functions can be realized. Moreover, the guide member A61 and the positioning member A62 can also be configured as a same component, and the component has both the positioning and guiding functions. For example, in the example shown in FIGS. 1 and 2, the dust accumulation base A has a special-shaped baffle A611. The shape of the special-shaped baffle A611 matches the shape of the corresponding part on the cleaning apparatus B. When the cleaning apparatus B is placed on the dust accumulation base A, the special-shaped baffle A611 can guide and position the cleaning apparatus B.

Figure 9:
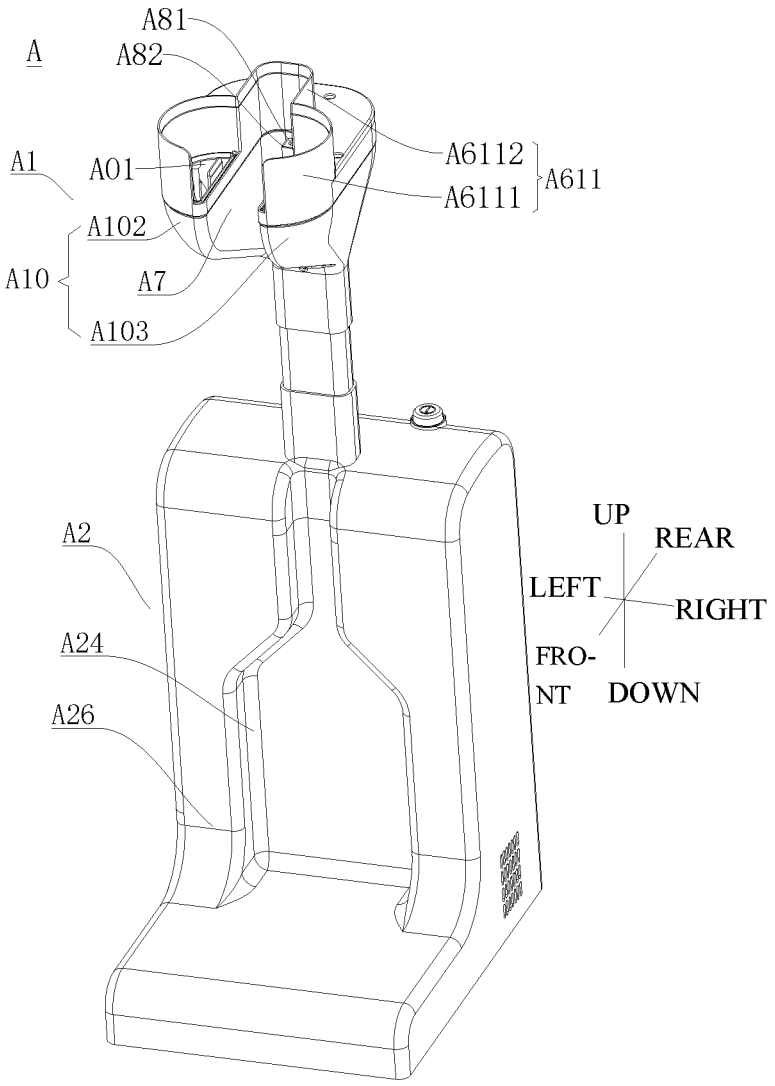
FIG. 9 is a perspective view of a dust accumulation base according to another embodiment of the present application.

In one embodiment, as shown in FIG. 9, the top of the support part A1 is provided with a special-shaped baffle A611 for guiding and positioning the cleaning apparatus B, and the special-shaped baffle A611 is provided corresponding to the avoidance area A7. The special-shaped baffle A611 includes: two dust cup stoppers A6111 which are respectively arranged along the contours of the two dust inlets A01 on the sides away from each other; and an avoidance stopper A6112 with two ends coupled to the two dust cup stoppers A6111 and arranged along the contour of the avoidance area A7. The avoidance stopper A6112 is coupled to one sides of the two dust cup stoppers A6111 facing the central area A1211. Thus, the special-shaped baffle A611 is formed as an integral part with both guiding and positioning functions.

In one embodiment, the present application is not limited to this. In other embodiments of the present application, the guide member A61 and the positioning member A62 may also be configured in other shapes, respectively. For example, the guide member A61 may be configured as a guide post, and the positioning member A62 may be configured as a positioning buckle, or the like, which will not be detailed here.

In some embodiments, the dust accumulation base A may include a seal member (not shown in the figure). The seal member is located at the edge of the dust inlet A01 and configured to achieve sealing when the dust accumulation base A and the cleaning apparatus B are butt-jointed. Therefore, the seal member can be configured to ensure that the dust outlet B1211 on the cleaning apparatus B and the dust inlet A01 on the dust accumulation base A are tightly butt-jointed. On the one hand, the dust suction efficiency can be improved, and on the other hand, dust can be prevented from leaking out of a butt joint, thus avoiding secondary pollution to the environment. For example, in a example of the present application, as shown in FIG. 5, the top surface of the dust accumulation base A may have a sealing groove A14 arranged around the dust inlet A01, and the seal member may be embedded in the sealing groove A14. When the cleaning apparatus B is supported on the edge of the dust inlet A01, the seal member and the cleaning apparatus B can form a seal around the dust inlet A01.

In one embodiment, the present application is not limited to this, and the dust inlet A01 is not limited to being formed on the support part A1. For example, the dust inlet A01 may also be arranged on the dust collection part A2. When located on the dust collection part A2, the dust inlet A01 can be fixed on the dust collection part A2; or a stretchable dust receiving cover can be arranged on the dust collection part A2. When the cleaning apparatus B is coupled to the support part are assembled in place, the dust receiving cover is pulled out to cover the dust outlet B1211.

In some embodiments, the dust accumulation base A may further include a first power port A81, and the first power port A81 is adapted to being butt-jointed to the second power port B23 on the cleaning apparatus B to charge the cleaning apparatus B. Therefore, when the cleaning apparatus B is placed on the dust accumulation base A, the dust accumulation base A can also be used to charge the cleaning apparatus B at the same time, thus achieving multiple functions; moreover, the user does not need to charge the cleaning apparatus B at other time, which facilitates the use. Moreover, the user places the cleaning apparatus B on the dust accumulation base A after use of the cleaning apparatus B, and during the period of time that the cleaning apparatus B is stored on the dust accumulation base A, the dust can be dumped out, the cleaning apparatus B can be charged and the user will not be worried about forgetting charging the cleaning apparatus B.

In some embodiments, as shown in FIG. 6, the air inlet pipe 01 of the cleaning apparatus B is provided with a second power port B23. When the cleaning apparatus B is fitted on the dust accumulation base A, the air inlet pipe 01 is located in the avoidance area A7. On the corresponding dust accumulation base A, as shown in FIG. 9, the first power port A81 is located on the support part A1 and in the avoidance area A7. In this case, the air inlet pipe 01 can be inserted into the avoidance area A7 and the second power port B23 is plugged into the first power port A81 to complete the connection. In use of this dust accumulation base A, when other suction accessories B03 are coupled to the air inlet pipe 01 on the cleaning apparatus B, the suction accessory B03 coupled to the air inlet pipe 01 can be detached, and then the first power port A81 can be connected.

In order to ensure that dust can also be dumped out of the cleaning apparatus B when the suction accessory B03 coupled to the air inlet pipe 01 is not detached, in some examples, the first power port A81 is arranged on a stretchable platform A82. As shown in FIG. 9, the stretchable platform A82 is arranged on the support part A1 in a horizontally stretching and retracting way. When the stretchable platform A82 stretches out, the first power port A81 extends into the avoidance area A7. In another example, the dust inlet A01 is configured to be relatively large, and a certain redundant space is provided in the avoidance area A7. When the suction accessory B03 coupled to the inlet pipe 01 is not detached, the cleaning apparatus B moves outward by a certain distance so that the suction accessory B03 avoids the first power port A81.

It is understandable that the structural form of the first power port A81 and the second power port B23 capable of fulfilling the above charging function and a principle of implementing charging will not be detailed here.

In one embodiment, in embodiments of the present application, the position of the first power port A81 is not limited to this. For example, a charging dock (not shown in the figure) connected by a wire is arranged on the dust collection part A2, and the first power port A81 is arranged on the charging dock.

In some embodiments, as shown in FIGS. 2 and 3, the dust accumulation base A may further include a dust bag A23 detachably arranged in the dust collection chamber A22. Therefore, the dust bag A23 can be configured to collect the dust flowing to the dust collection chamber A22, which is convenient for the user to dump the dust and ensures the cleanness of the dust collection chamber A22. In addition, the dust bag A23 is easy to disassemble, clean and replace, which is convenient for the user to operate and use. Here, it should be noted that a material of the dust bag A23 is not limited; for example, the dust bag A23 may be a paper bag, a mesh bag, a cloth bag or the like. In addition, the connection mode of the dust bag A23 and the dust collection chamber A22 is not limited as long as it is ensured that the dust bag A23 can be disassembled and assembled conveniently. For example, the dust collection chamber A22 may be provided therein with a movable buckle A221, the dust bag A23 may be provided with a locking plate A231, and the locking plate A231 can be positioned by the movable buckle A221 so that an inlet of the dust bag A23 comes into communication with an inlet of the dust collection chamber A22.

In addition, in some embodiments of the present application, as shown in FIG. 2, the dust collection part A2 may further include a supporting frame A28 arranged in the dust collection chamber A22, and the supporting frame A28 is configured to support the dust bag A23 to prevent the dust bag A23 from blocking the air passage hole A211. In one embodiment, the present application is not limited to this. The dust collection chamber A22 may not have a dust bag A23 therein. In this case, the dust collection chamber A22 may be provided therein with other filtering devices; for example, a filter screen is directly arranged at the air passage hole A211 or the like to prevent dirt from entering the motor chamber A21 to damage the suction device A3.

In some embodiments, as shown in FIG. 3, the dust collection part A2 may also be provided therein with a storage chamber A25, and the storage chamber A25 is not in communication with the motor chamber A21 and the dust collection chamber A22. Thus, the storage chamber A25 can be configured to store items, for example, to store accessories of the cleaning apparatus B, such as a floor brush, a pet brush, and the like, so that the dust accumulation base A has a storage function; therefore, the dust accumulation base A has powerful functions. It is worth noting that the location of the storage chamber A25 in the dust collection part A2 is not limited. For example, in the example shown in FIG. 2, the storage chamber A25 can be arranged on a horizontal side of the dust collection chamber A22 (e.g., the left side shown in FIGS. 2 and 3), reducing the structural difficulty and facilitating machining and use.

In one embodiment, as shown in FIGS. 3 and 1, a storage chamber A25 and a dust collection chamber A22 are defined in the vertical box A261, and the storage chamber A25 and the dust collection chamber A22 are respectively arranged adjacent to two side surfaces of the vertical box A261.

As shown in FIGS. 2 and 3, both the storage chamber A25 and the dust collection chamber A22 can be configured as chambers that can be opened, so that the user can take and place the item or change the dust bag A23 conveniently. For example, in a example of the present application, the dust collection part A2 may include a housing A26 and two cover plates A27 arranged on the housing A26. One of the cover plates A27 is configured to open and close the storage chamber A25, and the other cover plate A27 is configured to open and close the dust collection chamber A22. The structural shape and layout position of the cover plate A27 are not limited, and the connection mode of the cover plates A27 and the housing A26 is not limited as long as they can be disassembled and assembled conveniently. In addition, when the volume of the dust collection chamber A22 needs to be increased, the storage chamber A25 can also come into communication with the dust collection chamber A22, and the storage chamber A25 and the dust collection chamber A22 can both serve as the dust collection chamber A22.

In addition, the dust accumulation base A according to the embodiment of the present application may further include a switch A29. The switch A29 may be arranged on the dust collection part A2 or the support part A1, and after the switch A29 is triggered, the suction device A3 will start to work, bringing convenience for use and reducing the overall cost of the dust accumulation base A. In one embodiment, the present application is not limited to this, and the suction device A3 can be automatically started to work according to an actual situation by remote control, voice control, gravity induction control, or the like, which will not be detailed here.

The cleaning apparatus assembly 1000 according to the embodiment of the second aspect of the present application will be described below with reference to the drawings.

Figure 10:
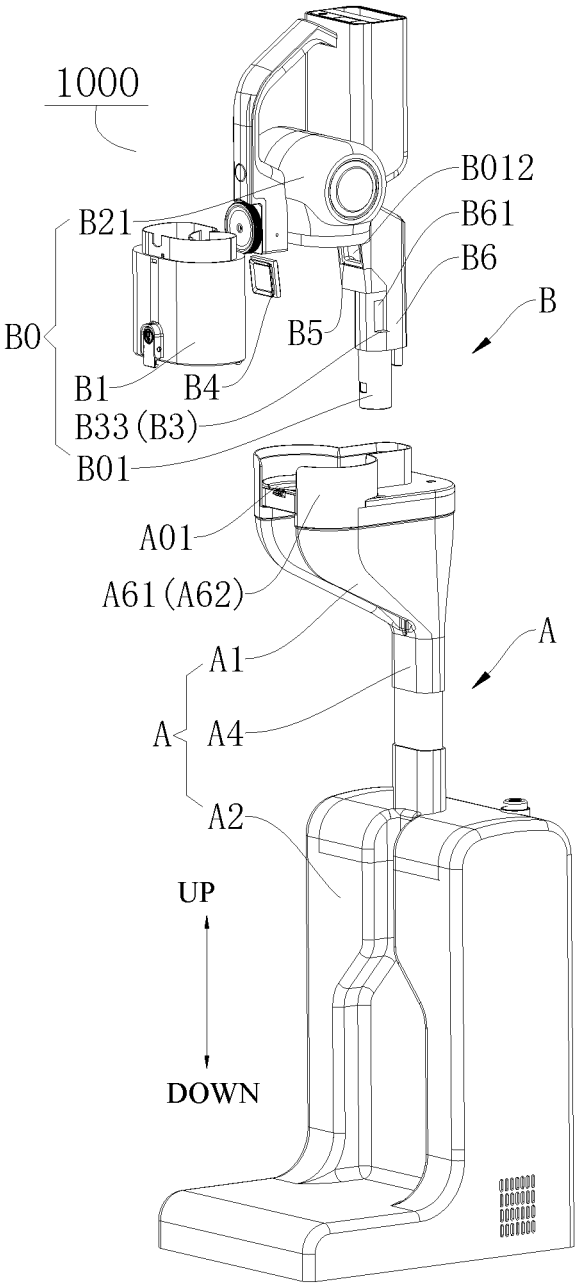
FIG. 10 is an exploded schematic structural diagram of a cleaning apparatus assembly according to an embodiment.

As shown in FIGS. 1 and 10, the cleaning apparatus assembly 1000 according to the embodiment of the second aspect of the present application may include a dust accumulation base A and a cleaning apparatus B, and the dust accumulation base A is the dust accumulation base A according to the embodiment of the first aspect of the present application, and the cleaning apparatus B includes a dust cup component B1; the dust accumulation base A is configured to support the cleaning apparatus B and suck dust from the dust cup component B1. It should be noted that the dust accumulation base A and the cleaning apparatus B can be separated, so the cleaning apparatus B is placed on the dust accumulation base A when the dust accumulation base A needs to be used, and the cleaning apparatus B is removed from the dust accumulation base A when the cleaning apparatus B needs to be used for cleaning operations.

Therefore, since the cleaning apparatus assembly 1000 according to the present application includes the dust accumulation base A, the dust accumulation base A can be used to hold the cleaning apparatus B, and the dust collection part A2 can be used to collect the dust in the cleaning apparatus B, facilitating the dust dumping of the cleaning apparatus B and improving the dust dumping effect of the cleaning apparatus B.

It should be noted that the type of the cleaning apparatus B according to the embodiment of the present application is not limited, for example, it can be a hand-held vacuum cleaner, a hand-held push-rod vacuum cleaner, a mopping vacuum cleaner, or the like. After the type of cleaning apparatus B is determined, other components of the cleaning apparatus B. For example, when the cleaning apparatus B is a hand-held push-rod vacuum cleaner, the cleaning apparatus B may include a body component B2, a push rod (not shown), a floor brush (not shown), and the like in addition to the dust cup component B1.

In some embodiments, during the processing of dust dumping, a pressure difference is formed between the cleaning apparatus B and the dust collection chamber A22 to generate airflow, bringing the dust into the dust collection chamber A22.

Figure 7:
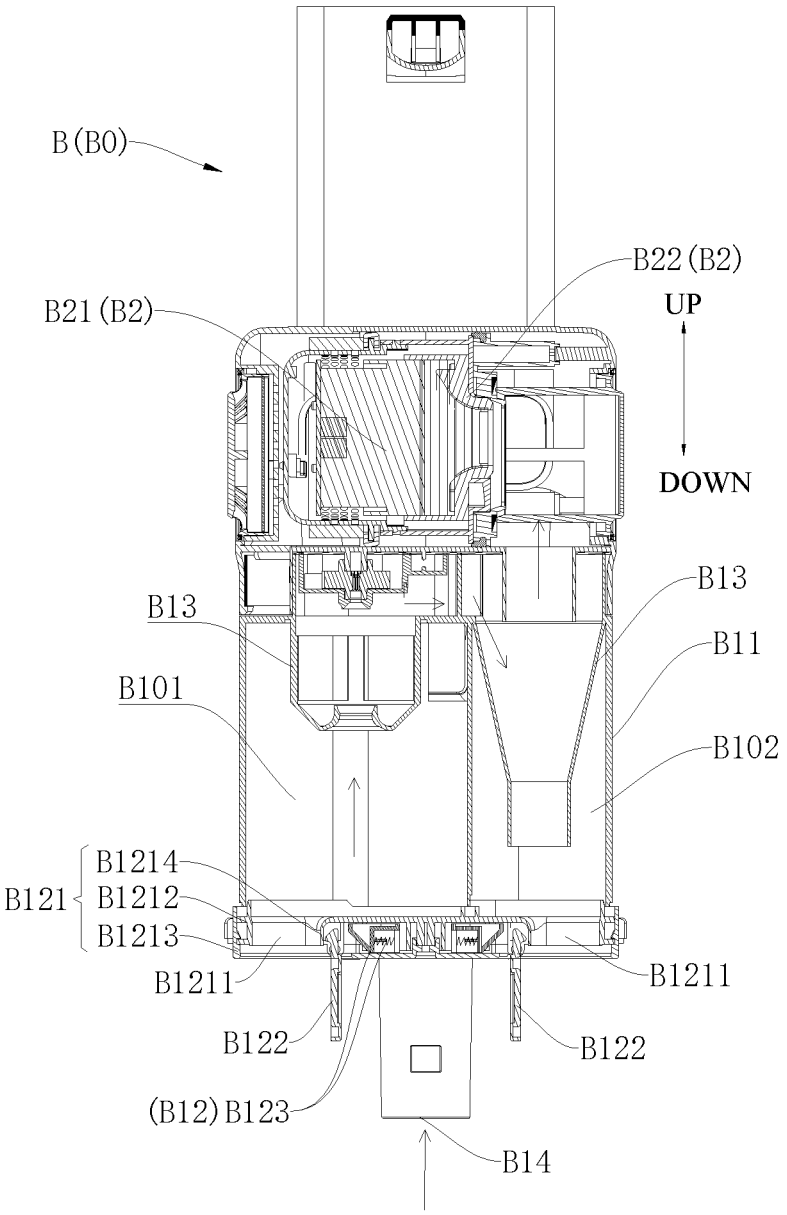
FIG. 7 is a cross-sectional view of the cleaning apparatus shown in FIG. 6.

In some embodiments, as shown in FIG. 7, the cleaning apparatus B includes a body component B2, and the body component B2 includes a motor assembly B21. The motor assembly B21 has a suction fan wheel B22 that can rotate forward to suck dust. The cleaning apparatus B can discharge dust by the suction fan wheel B22 that rotates backward. It should be noted here that when the cleaning apparatus B is separated from the dust accumulation base A, the motor assembly B21 in the cleaning apparatus B rotates forward to suck dust. When the motor assembly B21 rotates forward, as shown in FIG. 6, the dust is sucked into the suction opening B14 and enters the dust cup component B1 in the cleaning apparatus B. When the cleaning apparatus B needs to empty the dust, the suction fan wheel B22 rotates backward to discharge the dust. Alternatively, the dust accumulation base A has a suction device A3, and the suction device A3 performs suction on the dust cup component B1 to suck the dust.

In addition, the specific structure of the dust cup component B1 is not limited as long as the dust and air separation can be achieved. For example, in a example of the present application, as shown in FIGS. 6 and 7, the dust cup component B1 may be a cyclone separation type dust cup, and includes a primary separation chamber B101 and a secondary separation chamber B102. The primary separation chamber B101 is in airflow communication with the upstream of the secondary separation chamber B102. Dirty air sucked in by the dust cup component B1 from the suction opening B14 can first enter the primary separation chamber B101 for preliminary cyclone separation two throw out large particles of dust and hair, and the preliminarily separated air can then enter the secondary separation chamber B102 for another cyclone separation to throw out fine particles of dust, and then flow to the body component B2, improving the cleaning effect.

In one embodiment, as shown in FIG. 6, a filter element B13 is provided in the primary separation chamber B101 to increase the preliminary separation effect of dust and airflow.

In addition, when the primary separation chamber B101 and the secondary separation chamber B102 are arranged in sequence in a horizontal direction and are each provided with a dust outlet B1211 at the bottom, the first dust inlet A011 and the second dust inlet A012 can be respectively coupled to the two dust outlets B1211 correspondingly so that the first dust inlet A011 can collect the dust stored in the primary separation chamber B101 and the second dust inlet A012 can collect the dust stored in the secondary separation chamber B102.

In some embodiments, as shown in FIGS. 6 and 7, the dust cup component B1 may include a cup body B11 and a cup lid sub-component B12. A cup lid body B121 may be arranged on the cup body B11 and able to open and close, and the cup lid body B121 may also be fixed on the cup body B11. The cup lid sub-component B12 includes a cup lid body B121 and a dust outlet lid B122. The cup lid body B121 is provided with the dust outlet B1211. The dust outlet lid B122 is arranged on the cup lid body B121 and configured to open and close the dust outlet B1211. When the cleaning apparatus B and the dust accumulation base A are fitted in place, the dust outlet B1211 and the dust inlet A01 are opposite to each other.

Therefore, by placing the cleaning apparatus B on the dust accumulation base A and opening the dust outlet lid B122, the dust outlet B1211 and the dust inlet A01 can come into butt-jointed communication so that the dust accumulation base A can collect dust from the dust cup component B1. Because the dust outlet B1211 and the dust inlet A01 can come into butt-jointed communication, the leakage and raising of dust in the dust dumping process can be avoided, and secondary pollution to the environment can also be avoided. In addition, when the cup lid body B121 is coupled to the cup body B11 and can be opened and closed, the dust can also be manually dumped into an indoor trash can by opening the cup lid body B121, which is flexible in use.

In some embodiments, the structure of the cup lid body B121 is eliminated in the cup lid sub-component B12, the dust outlet lid B122 is provided at one end of the dust cup component B1, and the dust outlet lid B122 is arranged on the cup body B11 to open and close the dust outlet B1211, and a locking mechanism B123 can directly lock the dust outlet lid B122 on the cup body B11.

Figure 8:
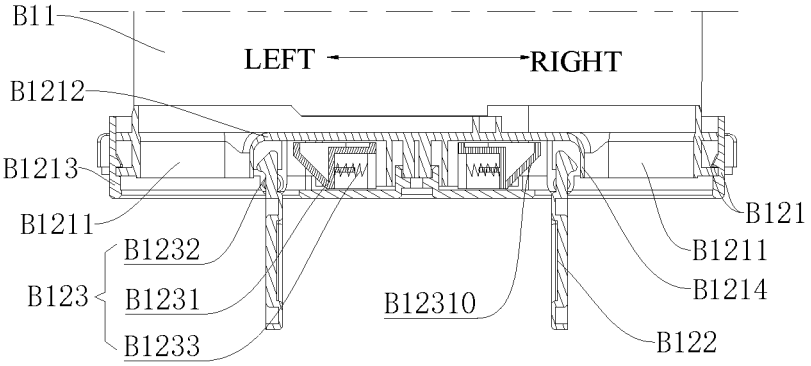
FIG. 8 is an enlarged view of a portion of the cleaning apparatus shown in FIG. 7.

In some embodiments, as shown in FIG. 8, the cup lid sub-component B12 may include the locking mechanism B123. The locking mechanism B123 is arranged between the dust outlet lid B122 and the cup lid body B121 and configured to drive the dust outlet lid B122 to close the dust outlet B1211. In this way, the dust outlet B1211 can be closed by the locking mechanism B123, and the user does not need to manually close the dust outlet lid B122, preventing the user's hands from getting dirty.

In some embodiments, the cleaning apparatus assembly 1000 may include an unlocking device C arranged on at least one of the dust cup component B1 and the dust accumulation base A; that is, the dust cup component B1 may be provided with the unlocking device C (this example is not shown in the figure), and the dust accumulation base A may also be provided the unlocking device C (as shown in FIG. 2). The dust cup component B1 and the dust accumulation base A may be each provided with the unlocking device C. The unlocking device C is configured to drive the locking mechanism B123 to unlock and drive the dust outlet lid B122 to open the dust outlet B1211.

In other words, the unlocking device C may be arranged on the cleaning apparatus B. For example, the unlocking device C may be configured as an unlocking switch; when touched by a human hand, the unlocking switch is triggered and the locking mechanism B123 is driven to unlock. The unlocking device C can also be arranged on the dust accumulation base A. When the cleaning apparatus B is coupled to the dust accumulation base A, the unlocking device C comes into contact with the locking mechanism B123, the locking mechanism B123 is triggered to unlock, and the dust outlet lid B122 opens the dust outlet B1211. It can be seen from the above structure that the dust outlet lid B122 arranged on the dust outlet B1211 of the cleaning apparatus B according to the embodiment of the present application is generally in a closed state under the action of the locking mechanism B123. Therefore, the dust outlet lid B122 always closes the dust outlet B1211 and the cleaning apparatus B can be conveniently used to clean dust and at the same time the dust is gradually accumulated in the dust cup component B1.

Since the cup body B11 has a certain dust holding capacity, when the dust is accumulated to a certain amount and the cleaning apparatus B needs to be emptied, the unlocking device C triggers the locking mechanism B123 and the locking mechanism B123 is then driven; as a result, the locking effect of the locking mechanism B123 on the dust outlet lid B122 is removed and the dust outlet lid B122 is opened immediately, and then the dust can be dumped out from the dust outlet B1211. In summary, since the cleaning apparatus B of the present application has an automatically openable dust outlet lid B122 structure, dust can be dumped conveniently and hands will not get dirty when dumping dust, reducing labor intensity when dumping dust.

Therefore, since the unlocking device C can be configured to drive the dust outlet lid B122 to open the dust outlet B1211, the user does not need to manually open the dust outlet lid B122, thus preventing the user's hands from getting dirty.

In one embodiment, the specific structures of the locking mechanism B123 and the unlocking device C are not limited as long as they can achieve the above-mentioned functions. A example will be briefly described below as an example, but the present application is not limited to this.

In some embodiments, as shown in FIG. 8, the locking mechanism B123 includes a slider B1231, a first return member B1232, and a second return member B1233. The first return member B1232 normally drives the dust outlet lid B122 to move in a direction of closing the dust outlet B1211, and the second return member B1233 normally drives the slider B1231 to stop the dust outlet lid B122 from moving in a direction of opening the dust outlet B1211. That is, the first return member B1232 effectively realizes the automatic closing of the dust outlet lid B122, and the second return member B1233 and the slider B1231 are used to lock the dust outlet lid B122 to avoid automatically opening the dust outlet B1211; in this way, the reliability and airtightness of dust storage of the dust cup component B1 can be improved and the cleaning apparatus B can be ensured to operate normally.

Here, the materials of the first return member B1232 and the second return member B1233 are not limited as long as they can achieve the above functions. For example, the first return member B1232 and the second return member B1233 can be springs, torsion springs, gear rack components, magnetic attraction parts, or the like.

In addition, the structure of the slider B1231 is not limited as long as the structure can achieve the above functions; for example, the slider B1231 can be configured as a slider with a guide rail or a slider with a guide surface.

In some embodiments, as shown in FIGS. 6 and 8, the dust outlet lid B122 is rotatably coupled to the cup body B11, that is, the dust outlet lid B122 is rotatable about the rotation axis relative to the cup body B11. In this case, the dust outlet lid B122 can move by way of rotating.

In one embodiment, the dust outlet lid B122 and the cup body B11 are connected in translation, that is, the dust outlet lid B122 moves parallel to the cup body B11. The specific connection structure of the dust outlet lid B122 and the cup body B11 is not limited, as long as it can achieve rotation or translation. A specific example where the dust outlet lid B122 and the cup body B11 are in rotating connection is described below to illustrate the fitting form of the dust outlet lid B122 and the locking mechanism B123.

In some examples, the dust outlet lid B122 is rotatably coupled to the cup lid body B121, the first return member B1232 normally drives the dust outlet lid B122 to turn over and close the dust outlet lid B1211, the slider B1231 is adjacent to a side of a rotation shaft of the dust outlet lid B122, and the second return member B1233 is coupled to one end of the slider B1231 and normally drives the slider B1231 to abut against a side of the dust outlet lid B122 facing the inside of the cup body B11.

In one embodiment, a guide surface is formed on the slider B1231 and the unlocking device C extends along the guide surface into a space between the slider B1231 and the dust outlet lid B122 so that the slider B1231 is separated from the dust outlet lid B122 and then the dust outlet lid B122 is unlocked to open the dust outlet B1211. Advantageously, as shown in FIG. 8, the guide surface is formed as an inclined guide surface B12310 which extends downward in the direction away from the dust outlet B1211; that is, an end of the inclined guide surface B12310 close to the dust outlet B1211 is higher and an end of the inclined guide surface B12310 far from the dust outlet B1211 is lower; and the end close to the dust outlet B1211 is more easily fitted on the dust outlet lid B122 to achieve locking.

Specifically, as shown in FIG. 8, the first return member B1232 is configured as a torsion spring wound on the rotation shaft of the dust outlet lid B122. When the dust outlet lid B122 is closed on the dust outlet B1211, the torsion spring accumulates energy. The second return member B1233 is a coil spring fitted over one end of the slider B1231. The slider B1231 is configured as a wedge block and has an inclined guide surface B12310. When the inclined guide surface B12310 is pushed upward by the unlocking device C, the slider B1231 moves horizontally and the coil spring is compressed to accumulate energy, to release and unlocking the dust outlet lid B122 to form an automatic opening structure. When the acting force of the unlocking device C is removed, the slider B1231 moves toward the dust outlet B1211 under the action of the coil spring, the dust outlet lid B122 closes the dust outlet B1211 under the action of the torsion spring, and in the meanwhile one end of the dust outlet lid B122 abuts against the slider B1231 to achieve locking.

In some examples, the dust outlet lid B122 and the cup body B11 are connected in translation. Correspondingly, in this case, a via hole is formed in the convex ring B1214 so that the dust outlet lid B122 can be moved to the side of the dust outlet B1211 or to the space between the dust outlet lids B1211 through the via hole, and the first return member B1232 and the second return member B1233 are formed as a set of parts, specifically as a magnetic member arranged at one end of the dust outlet lid B122 and a magnetic attraction member fitted on the dust outlet B1211. By virtue of a magnetic attraction force, the magnetic member and the magnetic attraction member can drive the dust outlet lid B122 to normally move in a direction of closing the dust outlet B1211; the second return member B1233 is configured as a tension spring provided at the other end of the dust outlet lid B122, and when the dust outlet lid B122 closes the dust outlet B1211, the tension spring is in a tensioned state. The magnetic attraction force is greater than the elastic restoring force of the tension spring. That is, without the unlocking device C providing an external force to overcome the difference in the force between the magnetic attraction force and the elastic restoring force of the tension spring, the dust outlet lid B122 normally closes the dust outlet B1211.

In one embodiment, the unlocking device C may include a motor, a damping gear, and a damping rack, and the damping gear is arranged on the dust outlet lid B122, the damping rack is arranged on the cup cover body B121, and a motor drives the damping gear to move relative to the damping rack. When the motor is turned on, the damping gear drives the dust outlet lid B122 to move along a path of the damping rack, so that the dust outlet lid B122 overcomes the magnetic attraction force of the magnetic member and the magnetic attraction member, and moves in a direction of opening the dust outlet B1211 under the action of the tension spring.

In the example shown in FIG. 2, the unlocking device C may include an unlocking member A5 arranged on the dust accumulation base A. When the cleaning apparatus B and the dust accumulation base A are fitted in place, the unlocking member A5 pushes the dust outlet lid B122 to turn over in the direction of opening the dust outlet B1211 and pushes the slider B1231 to slide in a direction of releasing the dust outlet lid B122. Therefore, by placing the cleaning apparatus B on the dust accumulation base A, the unlocking member A5 can automatically open the dust outlet lid B122 to realize the communication between the dust outlet B1211 and the dust inlet A01, without manual operation by the user, thus reducing the operating intensity and preventing the hands from getting dirty; after removing the cleaning apparatus B from the dust accumulation base A, the first return member B1232 can be used to simply and effectively realize the automatic closing of the dust outlet lid B122, and the second return member B1233 and the slider B1231 are used to lock the dust outlet lid B122 to avoid automatically opening the dust outlet B1211; in this way, the reliability and airtightness of dust storage of the dust cup component B1 can be improved and the cleaning apparatus B can be ensured to operate normally. In short, by providing the locking mechanism B123 and the unlocking device C of this embodiment, the dust outlet lid B122 can be automatically opened or closed.

In one embodiment, the unlocking member 5 includes a push plate A51 which is arranged adjacent to the dust inlet A01. When the dust outlet B1211 is butt-jointed toward the dust inlet A01, the push plate A51 pushes the dust outlet lid B122 to open the dust outlet B1211. In some specific examples, the push plate A51 can provide an upward pushing force, and the unlocking device C cooperates with the aforementioned case where the dust outlet lid B122 is rotatably coupled to the cup lid body B121. Advantageously, the push plates A51 are symmetrically arranged on the edges of the dust inlets A01 to avoid interference of the push plates A51 during work and facilitate machining.

In the specific example shown in FIG. 8, the cup lid body B121 has two dust outlets B1211, the dust cup component B1 includes two dust outlet lids B122, and the two dust outlet lids B122 are respectively used to open and close the two dust outlets B1211 correspondingly. The two dust outlet lids B122 are mirrored left and right, and two sliders B1231 that are mirrored left and right are arranged between the two dust outlet lids B122. Therefore, when the dust outlet lids B122 on the left and right sides adopt the same and mirrored locking mechanism B123 and unlocking device C, the dust outlet lids B122 on the left and right sides can be opened synchronously in the same way, and the dust outlet lids B122 can also be closed synchronously in the same way. Therefore, in order to simplify the description, only the dust outlet lid B122 on the left side is described as an example.

In the example of the dust outlet lid B122 on the left side, a right end of the slider B1231 is provided with a second return member B1233 (e.g., a return spring), the return spring pushes the slider B1231 to normally be at a left limit position to push against a right end of the dust outlet lid B122 on the left side so that the dust outlet lid B122 is in the close position. In this case, the first return member B1232 (e.g., a torsion spring) on the rotation shaft of the dust outlet lid B122 is in a natural state. When the cleaning apparatus B is placed on the dust accumulation base A, the push plate A51 on the left side as shown in FIG. 5 pushes upward the dust outlet lid B122 on the left side so that the dust outlet lid B122 turns over in a counterclockwise direction as shown in FIG. 8 to compress the torsion spring on the rotation shaft of the dust outlet lid B122 on the left side; in the meanwhile, the right end of the dust outlet lid B122 applies an upward pushing force to the inclined guide surface B12310 so that the left slider B1231 moves to the right to compress the return spring on the right side of the left slider B1231, thus reaching an unlocked state.

When the cleaning apparatus B is removed from the dust accumulation base A, as shown in FIG. 5, the push plate A51 on the left side is withdrawn downward relative to the dust outlet lid B122, and the torsion spring on the rotation shaft of the dust outlet lid B122 on the left side pushes the dust outlet lid B122 to turn over in the clockwise direction as shown in FIG. 8; in the meanwhile, the return spring on the right side of the left slider B1231 pushes the left slider B1231 to move to the left to push against the upper right end of the dust outlet lid B122 on the left side so that the dust outlet lid B122 is locked in the close position.

In some embodiments of the present application, the cup lid body B121 includes an inner lid B1212 and an outer lid B1213, the inner lid B1212 is fitted on the cup body B11, and the inner lid B1212 is provided with a dust outlet B1211. The outer lid B1213 is arranged on a side of the inner lid B1212 away from the cup body B11, and the locking mechanism B123 is arranged between the inner lid B1212 and the outer lid B1213. When two layers of lids are provided, a certain accommodating space is formed between the lids to arrange the locking mechanism B123, so that the arrangement position of the locking mechanism B123 is relatively concealed without being exposed, the locking mechanism B123 is prevented from the interference of dust when the dust is dumped, the operating reliability of various components is maintained. In this way, the dust outlet lid B122 can be locked by the locking mechanism B123 and remains closed continuously during the process of emptying dust from the cleaning apparatus B.

In one embodiment, as shown in FIGS. 7 and 8, the inner lid B1212 is provided with a convex ring B1214 surrounding the dust outlet B1211, and the dust outlet lid B122 is fitted on the convex ring B1214. Due to the arrangement of the convex ring B1214, when the dust outlet lid B122 opens the dust outlet B1211, on the one hand, it is conducive to the dust accumulated in the dust cup component B1 to fall along an inner wall of the convex ring B1214, forming a certain guiding effect; on the one hand, the convex ring B1214 cooperates with the dust outlet lid B122 to better seal the dust outlet B1211, so the size of the dust outlet lid B122 does not need to be too large. Multiple dust outlets B1211 and multiple dust outlet lids B122 may be designed, which is beneficial to reducing the weight of the single dust outlet lid B122. In this way, the locking force required by the locking mechanism B123 when locking the single dust outlet lid B122 does not need to be too large, which is beneficial to the simplified design of the locking mechanism B123.

In addition, the convex ring B1214 can be designed into a downwardly protruding structure. In this way, the convex rings B1214 are formed between the inner lid B1212 and the outer lid B1213; convex rings B1214 separate multiple spaces, and part of the spaces can be used for installing the locking mechanism B123, thus providing a reasonable layout space for the arrangement of the locking mechanism B123.

Advantageously, the convex ring B1214 is formed as a ring structure extending from the inner lid B1212 to the outer lid B1213, and two ends of the convex ring B1214 are respectively coupled to the inner lid B1212 and the outer lid B1213; in this way, a relatively closed dust outlet channel is formed so that the dust can be dumped smoothly without getting jammed. Correspondingly, a dust passage outlet corresponding to the dust outlet B1211 is also designed on the outer lid B1213, so that the dust can be quickly discharged.

In one embodiment, the dust outlet lid B122 is provided with a groove that matches with the convex ring B1214. When the dust outlet lid B122 is closed on the convex ring B1214, a better sealing effect is achieved between the dust outlet B1211 and the dust outlet lid B122 and the dust hardly leaks out.

In the figure, the cup lid body B121 is provided with two dust outlets B1211 and two corresponding dust outlet lids B122. Two locking mechanisms B123 are provided correspondingly and arranged between the two dust outlets B1211. In one embodiment, in other examples, the number of dust outlets B1211 may not be limited to two, but may be three or more, which is not limited specifically here. Advantageously, the dust outlets B1211 are spaced apart and evenly arranged relative to a point, so that projections of dust outlets B1211 in the horizontal direction cover horizontal projections of the separation chambers as much as possible to form rapid dust discharge.

On the cleaning apparatus B, a main body B0 of the cleaning apparatus B serves as the most basic structure for the operation of the cleaning apparatus B, and other structures may not be provided or may be provided and coupled to the main body B0. The main body B0 includes a dust cup component B1 and a body component B2. The cleaning apparatus B further includes other accessories detachably coupled to the main body B0.

Figure 11:
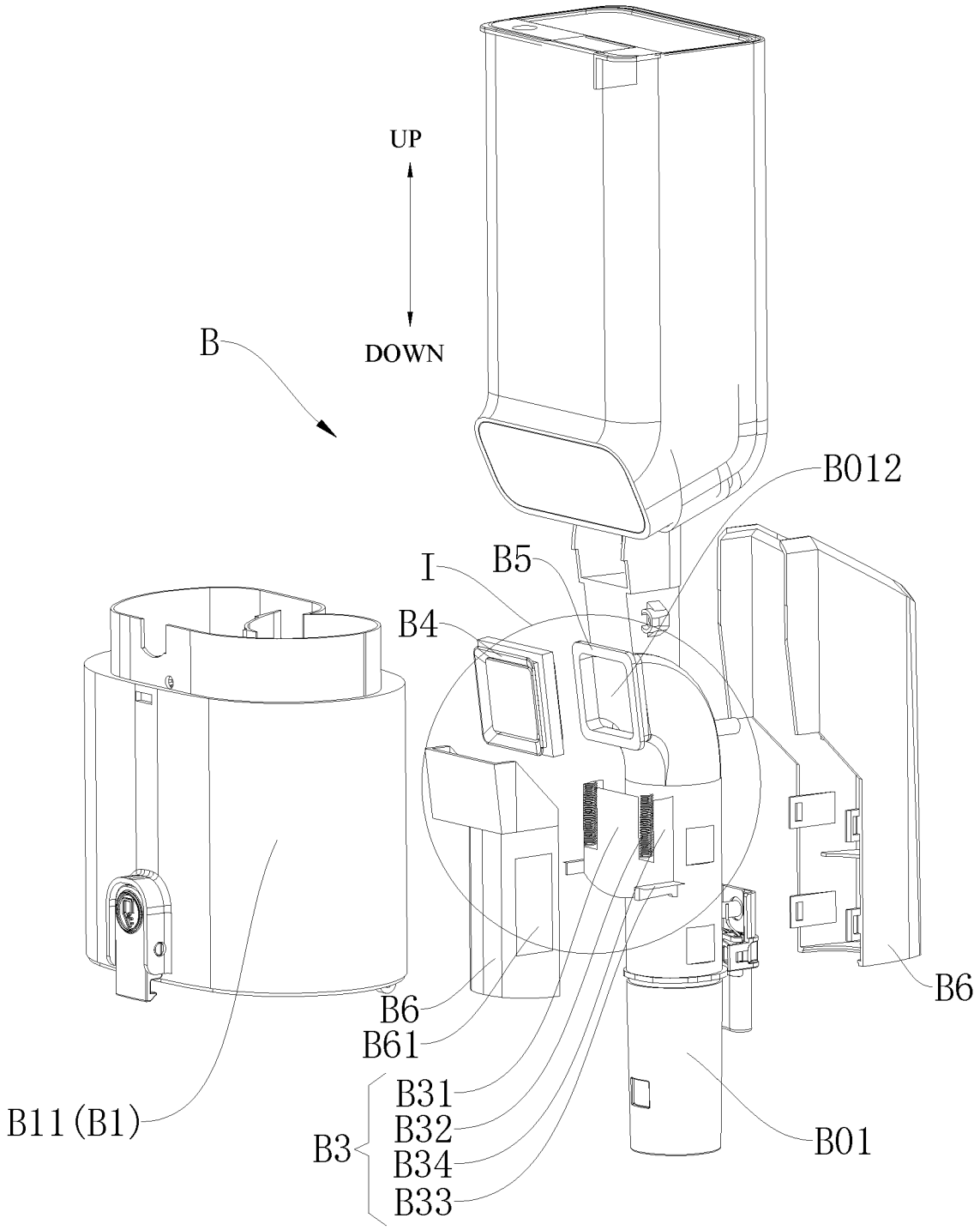
FIG. 11 is an exploded schematic structural diagram of a cleaning apparatus according to an embodiment (with a motor assembly hidden)
Figure 12:
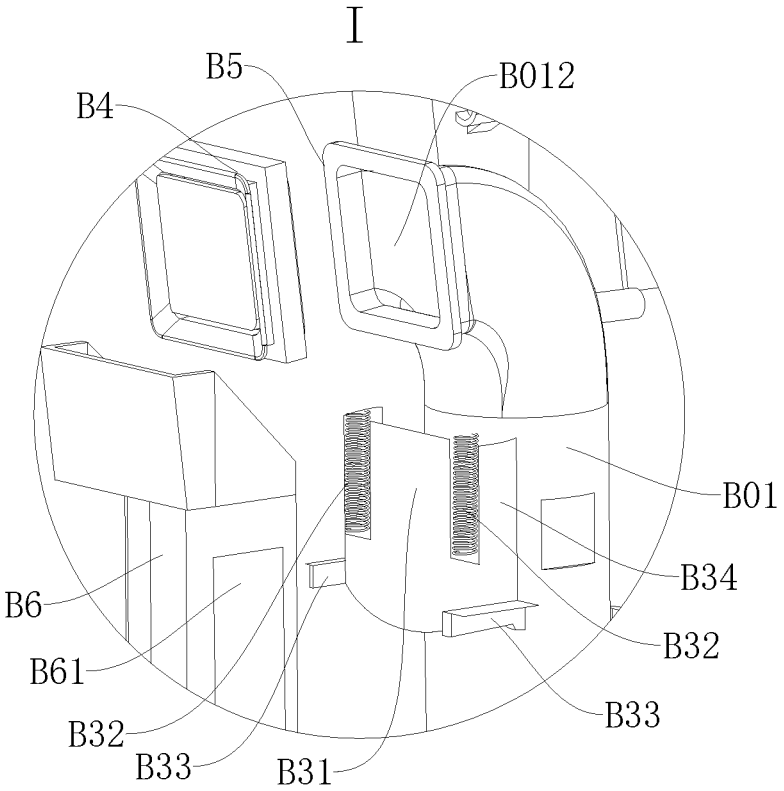
FIG. 12 is a partial enlarged view of region A in FIG. 11.
Figure 13:
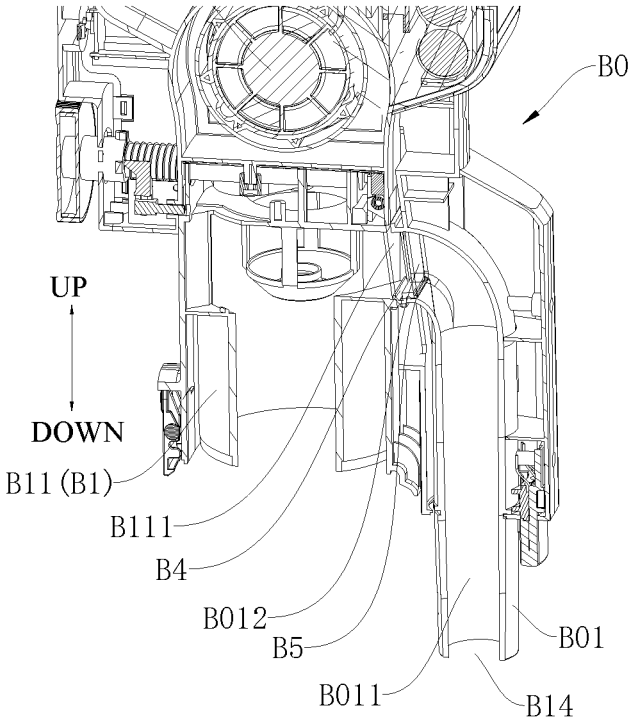
FIG. 13 is a schematic diagram of a longitudinal cross-sectional structure of a cleaning apparatus according to an embodiment the present application (with a cup lid sub-component and a closing component hidden).

In some embodiments, with reference to FIGS. 11 to 13, the main body B0 has a main suction channel B011 for air suction to the dust cup component B1 and an air outlet B02 for discharging air. The cleaning apparatus B further includes a closing component B3 that closes the main suction channel B011 when triggered. It should be noted here that when the cleaning apparatus B works for cleaning normally, the dust outlets B1211 are closed. Dust-containing air is sucked in from the main suction channel B011, and airflow in the dust cup component B1 rotates at a high speed. The dust in the airflow is separated from the airflow by a centrifugal force, and then the airflow in the dust cup component B1 is discharged toward the air outlet B02. The airflow discharged from the dust cup component B1 can be directly discharged from the air outlet B02, or the airflow can also pass through other dust removal processes such as a filter (such as hepa or filter cotton) before the air is discharged, which is not limited here.

If dust needs to be discharged out of a conventional cleaning apparatus, a usual method is to open the dust outlet lid and put the dust outlet downwards so that the dust is discharged freely by gravity. In this way, it is difficult to discharge dust at corners in the dust cup component and the dust is always attracted to the inner wall of the dust cup component under the action of static electricity and the like.

In the embodiment of the present application, by providing the closing component B3, the cleaning apparatus B can realize a brand-new dust discharging method. Specifically, in the process of discharging dust out of the cleaning apparatus B, the main suction channel B011 can be closed by the closing component B3, air is sucked in from the air outlet B02, and the air discharges sundries out of the main body B0 from the dust outlet B1211. Here, the airflow can discharge the dust from the dust outlet B1211 by way of blowing air toward the dust cup component B1 so that the dust cup component B1 forms a positive pressure relative to the outside atmosphere. In this way, the dust attached to the inner wall can be blown out more easily under a certain pressure difference, improving the cleanliness and efficiency of dust discharging. The airflow can also discharge the dust by way of sucking air into the dust cup component B1 so that the dust cup component B1 forms a negative pressure relative to the outside atmosphere. In this way, the dust attached to the inner wall can be removed more easily under a certain pressure difference, improving the cleanliness and efficiency of dust discharging.

What needs to be added here is that if the air outlet B02 is closed by the closing component B3, the air flows in from the main suction channel B011 and then is discharged from the dust outlet B1211. In this way, since wind resistance from the main suction channel B011 to the dust outlet B1211 is too small, it is always difficult to maintain a certain positive or negative pressure in the dust cup component B1, and in the main body B0, due to the easy pressure relief, the pressure difference cannot be used to cause dust to be removed from the inner wall. In the embodiment of the present application, since the air is sucked in from the air outlet B02, it is easier to form a certain pressure difference between the inside of the main body B0 and the outside atmosphere, so that the dust can be dumped more thoroughly.

In addition, sucking the air in from the air outlet B02 can also bring the dust between the dust cup component B1 and the air outlet B02 to the dust outlet B1211, further improving the cleanliness of the cleaning apparatus B. For example, when a filter is provided between the dust cup component B1 and the air outlet B02, the dust will be blocked by a windward side of the filter when the cleaning apparatus B works normally for cleaning, and in the case of dust dumping, the air is sucked in from the opposite direction, the dust on the windward side will be brought by the airflow to the dust outlet B1211, that is, the dust dumping operation also can clean the filter.

It is understandable that, compared with a cleaning apparatus using manual dust discharging in the prior art, the cleaning apparatus B of the present application can discharge the dust quickly without causing raised dust or dirtying the hands. Compared with the prior art using a fluid (water or high-pressure airflow) to wash the dust in the apparatus, the cleaning apparatus B of the present application has a simple structure and a good dust discharging effect since no booster device is designed therein.

In some embodiments of the present application, as shown in FIG. 13, the dust cup component B1 has a dust cup inlet B111; the main body B0 includes an air inlet pipe B11, one end of the air inlet pipe B01 is configured as a connection opening B012 coupled to the dust cup inlet B111, and the main suction channel B011 is defined in the air inlet pipe B01. The closing component B3 extends into a space between the connection opening B012 and the dust cup inlet B111 when triggered. Here, it should be noted that the air inlet pipe B01 and an outer wall of the dust cup component B1 may be configured as two parts, and the dust cup inlet B111 and the connection opening B012 are configured as two independent openings; the air inlet pipe B01 may also be integrally formed one the outer wall of the dust cup component B1, and in this case the dust cup inlet B111 and the connection opening B012 are the same opening.

When the air inlet pipe B01 and the outer wall of the dust cup component B1 are configured as two independent parts, other connecting parts (such as a first seal member B4 and the second seal member B5 described later) can be arranged between the air inlet pipe B01 and the outer wall of the dust cup component B1, No matter how the structures of the dust cup inlet B111 and the connection opening B012 are designed, a certain space needs to be formed between the air inlet pipe B01 and the outer wall of the dust cup component B1, so that the closing component B3 extends in the space and the chamber in the dust cup component B1 and the air inlet pipe B01 do not come into communication with each other. In the following, the structure where the dust cup inlet B111 and the connection opening B012 are designed as two opening is used to describe the manner in which the closing component B3 of the embodiment of the present application closes the main suction channel B011.

As shown in FIGS. 12 and 13, the main body B0 further includes a first seal member B4 and a second seal member B5. The first seal member B4 is arranged around the dust cup inlet B111, and the second seal member B5 is arranged around the connection opening B012. The closing component B3 extends a space between the first seal member B4 and the second seal member B5 when triggered. On the one hand, the first seal member B4 and the second seal member B5 can surround the dust cup inlet B111 and the connection opening B012 respectively and ensure better sealing performance after the two openings are connected, which facilitates dust suction from the air inlet pipe B01 when the cleaning apparatus B works for sucking dust. On the other hand, the first seal member B4 and the second seal member B5 can also take a certain guiding effect at the junction. When moving from the outside to a gap between the first seal member B4 and the second seal member B5, the closing component B3 can push and open joint edges of the first seal member B4 and the second seal member B5 and extend into the gap between the first seal member B4 and the second seal member B5, and finally close the main suction channel B011. In addition, the first seal member B4 and the second seal member B5 also protect the walls of the dust cup inlet B111 and the connection opening B012 from being worn by the closing component B3, and improve the effectiveness and durability of the closing component B3 in blocking the main suction channel B011.

In one embodiment, in some embodiments, the main body B0 does not need to be provided with the first seal member B4 and the second seal member B5. In this case, only a channel that can be opened and closed and fits with the closing component B3 needs to be formed in the air inlet pipe B01 and close to the connection opening B012. When the cleaning apparatus works for cleaning, the channel that can be opened and closed is closed. When dust needs to be discharged, the channel that can be opened and closed is opened, and then the closing component B3 extends into the air inlet pipe B01 from the channel that can be opened and closed.

In some other embodiments, a portion of the closing component B3 constitutes a portion of the channel that can be opened and closed when the channel is closed, and the closing component B3 can slide or rotate relative to the channel that can be opened and closed. When the cleaning apparatus works for cleaning, the end of the closing component B3 closes the channel that can be opened and closed. When dust needs to be discharged, the closing component B3 slides or rotates toward the air inlet pipe B01 and cuts off the air inlet pipe B01, sealing the chambers on two sides.

In some embodiments, the closing component B3 is arranged on the main body B0. It occupies less external space, will not get lost easily, and facilitates the design of an automatic air path closing structure.

In some embodiments, referring again to FIGS. 11 and 12, the closing component B3 includes: a closing door B31, a normally open return member B32, and an adjusting member B33.

The closing door B31 has a close position for closing the main suction channel B011 and an open position for opening the main suction channel B011. In the example, as disclosed above, where the closing component B3 extends into the space between the connection opening B012 and the dust cup inlet B111 when triggered, in the close position, the closing door B31 extends into the above-mentioned space between the connection opening B012 and the dust cup inlet B111 to close the main suction channel B011, and in the open position, the closing door B31 exits from the main suction channel B011, so that the main suction channel B011 comes into communication with the dust cup component B1.

Advantageously, the closing door B31 is formed into a shape that fits with a cavity section of the main suction channel B011, so that the closing door B31 can close the main suction channel B011 as much as possible after extending into the main suction channel B011.

The normally open return member B32 in the closing component B3 normally drives the closing door B31 to move toward the open position. That is, when the closing door B31 is in the close position, the closing component B3 normally drives the closing door B31 so that the closing door B31 has a tendency to move toward the open position.

In one embodiment, the normally open return member B32 is configured as a spring. When the closing door B31 is in the close position, the spring accumulates energy. When the closing component B3 loses an external triggering force, the spring releases the energy so that the closing door B31 exits from the main suction channel B011 until the closing door B31 moves to the open position.

In one embodiment, one end of the spring is coupled to the closing door B31, and the other end of the spring is coupled to the outer wall of the air inlet pipe B01.

In addition, the adjusting member B33 in the closing component B3 is coupled to the closing door B31 and drives the closing door B31 to move when triggered. The adjusting member B33 gives the closing component B3 an action point that is triggered by an external force, so that the closing component B3 is quickly triggered to close the main suction channel B011 when triggered.

In the embodiment of the present application, the adjusting member B33 has many structural forms. For example, the adjusting member B33 is located outside the main body B0. When the adjusting member B33 is manually moved, the elastic force of the normally open return member B32 can be overcome to drive the closing door B31 to take a closing action. For another example, the adjusting member B33 is configured as an electronically controlled actuating member (such as a solenoid valve). The adjusting member B33 can act after receiving an electric control signal of closing, and overcome the elastic force of the normally open return member B32 to drive the closing door B31 to take a closing action; after receiving an electric control signal of opening, the adjusting member B33 can act again to leave the closing door B31, and the closing door B31 will take an opening action under the elastic force of the normally open return member B32.

In some examples, as shown in FIG. 12, the closing component B3 further includes: a guide sheet B34. The guide sheet B34 is annular or semi-annular and is fitted over the main suction channel B011, specifically fitted over the outer wall of the air inlet pipe B01. The closing door B31 is coupled to the guide sheet B34. The guide sheet B34 increases the movement stability of the closing component B3 when the closing component B3 is triggered, so that the closing door B31 opens and closes the main suction channel B011 in a specific direction.

In one embodiment, the adjusting member B33 is coupled to the outside of the guide sheet B34. Further, in one embodiment, the adjusting member B33 is arranged on a peripheral surface of the guide sheet B34 and extends out from the inside of the main body B0. When the adjusting member B33 is triggered to slide, the adjusting member B33 drives the guide sheet B34, and the guide sheet B34 drives the closing door B31 to slide. In this way, since the closing door B31 is driven by the guide sheet B34, the stability of the closing door B31 taking opening and closing actions is further improved by the guiding effect of the guide sheet B34.

In one embodiment, referring again to FIG. 11, the main body B0 further includes a protective shell B6 covering an outer side of the main suction channel B011, an accommodation chamber is defined between the protective shell B6 and the outer wall of the main suction channel B011, and the closing component B3 is located in the accommodation chamber. The protective shell B6 can cover a portion of the structure of the air inlet pipe B01 and can also cover a joint structure between the dust cup component B1 and the air inlet pipe B01 so that the main body B0 has a good integrity and a neater appearance. In addition, since the closing component B3 is arranged in the accommodation chamber, various components of the closing component B3 can be protected, and it is ensured that the closing component B3 is not affected by the external environment when taking an action.

In one embodiment, the protective shell B6 is formed as a multi-piece sub-shell. At least a portion of the multi-piece sub-shell is coupled to the air inlet pipe B01 and the main body B0, so that the protective shell B6 is stably coupled to the main body B0 and the air inlet pipe B01.

Advantageously, as shown in FIGS. 11 and 12, a sliding groove B61 is formed in the protective shell B6, and the adjusting member B33 extends out of the main body B0 from the sliding groove. That is, the adjusting member B33 can slide in the sliding groove B61 and the sliding groove B61 restricts a limit position of the movement of the adjusting member B33 so that the closing door B31 is stopped at a proper position.

In one embodiment, the closing door B31 can slide along a direction parallel to the axis of the dust cup component B1, and the sliding groove B61 extends along the direction parallel to the axis of the dust cup component B1.

In some embodiments, as shown in FIG. 6, the dust outlet B1211 is located at an axial end of the dust cup component B1. As shown in FIG. 12, the normally open return member B32 pushes the closing door B31 toward the dust outlet B1211, and the principle of action here can be referred to the principle of action of the spring described above.

Specifically, the dust accumulation base A is provided with a trigger (not shown in the figure). After the dust accumulation base A and the cleaning apparatus B are fitted in place, the dust inlet A01 is butt-jointed to the dust outlet B1211, and the trigger triggers the closing component B3 to close the main suction channel B011 (the structure of the main suction channel B011 is shown in FIG. 13).

In one embodiment, the trigger is formed on the inner wall of the avoidance area A7 of the support part A1. When the cleaning apparatus B is butt-jointed to the dust accumulation base A, the closing component B3 of the cleaning apparatus B is partially inserted in the avoidance area A7, so that the trigger triggers the closing component B3 when coming into contact with the closing component B3. For example, when the cleaning apparatus B is inserted into the avoidance area A7 from top to bottom, the trigger pushes the adjusting member B33 to move upward (away from the dust outlet B1211), so that the closing door B31 moves upward into the air inlet pipe B01 to close the main suction channel B011. It is understandable that when the cleaning apparatus B of the present application is butt-jointed to the dust accumulation base A, the dust outlet B1211 can be automatically butt-jointed to the dust inlet A01, the main suction channel B011 can be automatically closed, and the dust outlet lid B122 can automatically open the dust outlet B1211.

In summary, in the cleaning apparatus assembly 1000 of the embodiment of the present application, when the cleaning apparatus B is fitted with the dust accumulation base A, the dust inlet A01 and the dust outlet B1211 are immediately butt-jointed, and at this time, the unlocking device C triggers the locking mechanism B123 to be unlocked, and then the dust outlet lid B122 is driven to automatically open the dust outlet B1211. In the meanwhile, the trigger triggers the adjusting member B33, and pushes the adjusting member B33 to move away from the dust outlet B1211, so that the closing door B31 moves toward the close position to close the main suction channel B011 and the air outlet B02 of the cleaning apparatus B comes into communication with the chamber in the dust accumulation base A. Under the action of the suction device A3, a relatively large suction force is formed in the cleaning apparatus B so that the dust stored in the dust cup component B1 quickly enters the dust accumulation base A from the dust outlet B1211 and the dust inlet A01 which are butt-jointed, thus achieving automatic dust discharging. In this way, the dust outlet lid B122 does not need to be manually opened, the hands will not get dirty, and the dust can be discharged quickly and efficiently. Moreover, problems such as dust leakage and raising during the dust dumping process and secondary pollution to the environment can be avoided.

In the description of the present application, it should be understood that the orientation or position relationship indicated by the terms "upper," "lower," "vertical," "horizontal," "inner," "outer," etc. are based on the orientation or position relationship shown in the accompanying drawings and are intended to facilitate the description of the present application and simplify the description only, rather than indicating or implying that the apparatus or element referred to must have a particular orientation or be constructed and operated in a particular orientation, and therefore are not to be interpreted as limiting the present application.

Moreover, the terms "first" and "second" are used for descriptive purposes only and are not to be construed as indicating or implying a relative importance or implicitly indicating the number of embodiments indicated. Thus, features defined by the term "first" or "second" may include one or more such features, either explicitly or implicitly. In the description of the present application, the term "a plurality of" means two or more than two, unless specifically defined otherwise.

In the present application, unless otherwise stated and defined explicitly, the terms such as "mounted" "linked," "connected," and "fixed" should be understood in a broad sense; for example, a connection may be a direct connection, an indirect connection through an intermediate medium, or a communication inside two components or interaction between two components. The specific meanings of the above terms in the present application can be understood based on a specific situation.

In the description of the present specification, the description of reference terms such as "an embodiment" or "an example" means that specific features, structures, materials or characteristics described in connection with the embodiment or the example are included in at least one embodiment or example of the present application. In the present specification, the schematic representation of the above terms is not necessarily directed to the same embodiment or example. Furthermore, the specific features, structures, materials, or characteristics described may be combined in a suitable manner in any one or more embodiments or examples. In addition, integration and combination of various embodiments or examples described in the present specification, as well as features of various embodiments or examples, without contradicting each other.

What is claimed is:

1. A dust accumulation base, comprising:

a dust collection part having a dust collection chamber for collecting dust from a cleaning apparatus, and a dust inlet in communication with the dust collection chamber; and a support part configured to support the cleaning apparatus, and having a first avoidance recess for accommodating a suction tube of the cleaning apparatus;

wherein the first avoidance recess is defined within a front panel of the support part;

the dust accumulation base defines a dust passage chamber, and the dust passage chamber comprises a gathering chamber and a branch channel;

the branch channel has a first end coupled to the dust inlet and a second end in communication with the gathering chamber;

the gathering chamber has a dust collection opening at a bottom of the gathering chamber and in communication with the dust collection chamber;

the dust inlet comprises a plurality of dust inlets, and the branch channel comprises a plurality of branch channels;

the plurality of dust inlets correspond to the plurality of branch channels; and a flow area of each branch channel gradually decreases in a direction from the dust inlet to the gathering chamber.

2. The dust accumulation base according to claim 1, wherein the support part comprises a plurality of support sub-parts for supporting the cleaning apparatus, the first avoidance recess is defined between at least two of the support sub-parts, and the first avoidance recess is open on one horizontal side and on two vertical sides.

3. The dust accumulation base according to claim 1, wherein the support part is located above the dust collection part, and a second avoidance recess is arranged on a side wall of the dust collection part and configured to accommodate the suction tube.

4. The dust accumulation base according to claim 3, wherein the second avoidance recess has a narrow upper portion and a wide lower portion, and the second avoidance recess has an upwardly penetrating avoidance opening corresponding to the first avoidance recess.

5. The dust accumulation base according to claim 3, wherein a housing of the dust collection part comprises:

a vertical box arranged vertically and having a front surface and two side surfaces, the front surface of the vertical box being wider than each of the two side surfaces of the vertical box, the second avoidance recess being formed in the front surface of the vertical box; and a horizontal seat horizontally coupled to a bottom of the vertical box.

6. The dust accumulation base according to claim 5, wherein a bottom surface of the second avoidance recess is flush with an upper surface of the horizontal seat, or the bottom surface of the second avoidance recess and the upper surface of the horizontal seat are connected in an arc transition.

7. The dust accumulation base according to claim 5, wherein the vertical box defines a storage chamber and the dust collection chamber, and the storage chamber and the dust collection chamber are correspondingly arranged adjacent to the two side surfaces of the vertical box.

8. The dust accumulation base according to claim 7, wherein the storage chamber and the dust collection chamber are both configured as openable chambers, the dust collection part comprises cover plates correspondingly arranged on the two side surfaces of the vertical box, a first cover plate of the cover plates is configured to open and close the storage chamber, and a second cover plate of the cover plates is configured to open and close the dust collection chamber.

9. The dust accumulation base according to claim 3, wherein:

the support part is coupled to the dust collection part by a strut; or the support part and the dust collection part are separate parts, and the support part is fixed to an external object by a supporting and fixing assembly.

10. The dust accumulation base according to claim 3, wherein:

the support part and the dust collection part are detachably connected by a strut; and/or the support part and the dust collection part are connected at an adjustable distance through the strut.

11. The dust accumulation base according to claim 1, further comprising: a dust bag detachably arranged in the dust collection chamber.

12. The dust accumulation base according to claim 1, further comprising a first power port configured to couple to a second power port of the cleaning apparatus.

13. The dust accumulation base according to claim 12, wherein the first power port is arranged on the support part and located in the first avoidance recess.

14. The dust accumulation base according to claim 1, wherein:

the gathering chamber is located below the dust inlet, and horizontal projections of the dust inlet and the gathering chamber do not overlap; and the branch channel is curved.

15. The dust accumulation base according to claim 1, wherein the dust inlet and the dust passage chamber are both formed in the support part.

16. The dust accumulation base according to claim 15, wherein the support part comprises;

a support bottom shell having an open top to form a fitting opening, the dust collection opening being formed at a bottom of the support bottom shell; and a support seat shell fitted on the fitting opening, the dust inlet being formed in the support seat shell, and the dust passage chamber being defined between the support seat shell and the support bottom shell.

17. The dust accumulation base according to claim 16, wherein:

the fitting opening comprises a central area and a plurality of branch areas, an end of each of the plurality of branch areas extends to the central area, and a contour line of the fitting opening forms a closed loop;

the dust collection opening is located below the central area, and the support bottom shell has a shape that gradually changes downward from a contour of the fitting opening to a contour of the dust collection opening;

a contour shape of the support seat shell is consistent with a contour shape of the fitting opening, and the support seat shell is provided with the plurality of dust inlets corresponding to the branch areas;

an area of the support part between two adjacent branch areas and the central area forms the first avoidance recess.

18. The dust accumulation base according to claim 17, wherein a bottom of the support seat shell forms a press block extending into the support bottom shell, and at least a portion of a bottom surface of the press block located between the dust inlet and the central area is formed as a curved guide surface gradually extending downward towards the central area.

19. The dust accumulation base according to claim 18, wherein the support bottom shell and the support seat shell are both integrally formed parts, and a portion of the support seat shell is recessed downward to form the press block.

20. The dust accumulation base according to claim 1, wherein the plurality of dust inlets are arranged on two sides, located in the first avoidance recess, of a top surface of the support part.

21. The dust accumulation base according to claim 20, wherein:

a shaped baffle is arranged on a top of the support part and configured to guide and position the cleaning apparatus, the shaped baffle being arranged corresponding to the first avoidance recess;

the shaped baffle comprises:

two dust cup stoppers correspondingly arranged along contours of sides, away from each other, of two dust inlets of the plurality of dust inlets; and an avoidance stopper with two ends coupled to the two dust cup stoppers and arranged along a contour of the first avoidance recess.

22. The dust accumulation base according to claim 1, wherein the dust collection part defines a motor chamber; the dust accumulation base comprises a suction device arranged in the motor chamber and configured to allow the dust collection chamber to suck dust from the cleaning apparatus through the dust inlet.

23. The dust accumulation base according to claim 22, wherein the support part is located above the dust collection part; the dust accumulation base further comprising a garbage pipe extending in a vertical direction and communicating the dust collection chamber with the dust inlet.

24. The dust accumulation base according to claim 1, further comprising:

an unlocking member configured to open a dust outlet lid on the cleaning apparatus.

25. The dust accumulation base according to claim 24, wherein the dust inlet comprises a first dust inlet and a second dust inlet arranged in parallel, the unlocking member comprises two push plates arranged axisymmetrically and arranged at an edge of the first dust inlet and an edge of the second dust inlet correspondingly.

26. A cleaning apparatus assembly, comprising:

a cleaning apparatus comprising a dust cup component and a body component; and the dust accumulation base according to claim 1, the dust accumulation base being configured to support the cleaning apparatus.

27. The cleaning apparatus assembly according to claim 26, wherein:

the body component has a suction fan wheel capable of rotating forward to suck dust, and the cleaning apparatus discharges dust by the suction fan wheel rotating backward; or the dust accumulation base has a suction device configured to suck dust from the dust cup component.

28. The cleaning apparatus assembly according to claim 26, wherein:

the dust cup component comprises a cup body and a cup lid sub-component;

the cup lid sub-component comprises:

a cup lid body arranged on the cup body and being able to open and close, or fixed on the cup body, the cup lid body having a dust outlet, the dust outlet and the dust inlet being corresponding to each other when the cleaning apparatus and the dust accumulation base are fitted in place; and a dust outlet lid arranged on the cup lid body and configured to open and close the dust outlet.

29. The cleaning apparatus assembly according to claim 28, wherein the cup lid sub-component further comprises a locking mechanism arranged between the dust outlet lid and the cup lid body and configured to drive the dust outlet lid to close the dust outlet.

30. The cleaning apparatus assembly according to claim 29, wherein the cup lid body comprises:

an inner lid fitted on the cup body, having the dust outlet, and provided with a convex ring surrounding the dust outlet, the dust outlet lid being fitted on the convex ring; and an outer lid arranged on a side of the inner lid away from the cup body, the locking mechanism being arranged between the inner lid and the outer lid.

31. The cleaning apparatus assembly according to claim 29, further comprising: an unlocking device arranged on at least one of the dust cup component and the dust accumulation base and configured to drive the locking mechanism to unlock and open the dust outlet lid from the dust outlet.

32. The cleaning apparatus assembly according to claim 31, wherein the locking mechanism comprises a slider, a first return member and a second return member, the first return member drives the dust outlet lid to move in a direction of closing the dust outlet, and the second return member drives the slider to stop the dust outlet lid from moving in a direction of opening the dust outlet lid.

33. The cleaning apparatus assembly according to claim 32, wherein:

the dust outlet lid is rotatably coupled to the cup lid body, and the first return member drives the dust outlet lid to turn over and close the dust outlet;

the slider is adjacent to a side of a rotation shaft of the dust outlet lid, and the second return member is coupled to an end of the slider and drives the slider to abut against a side of the dust outlet lid facing an inside of the cup body.

34. The cleaning apparatus assembly according to claim 33, wherein the slider is formed with a guide surface, and the unlocking device extends into between the slider and the dust outlet lid along the guide surface to separate the slider from the dust outlet lid.

35. The cleaning apparatus assembly according to claim 32, wherein:

the unlocking device comprises an unlocking member arranged on the dust accumulation base;

when the cleaning apparatus and the dust accumulation base are fitted in place, the unlocking member pushes the dust outlet lid to turn over in the direction of opening the dust outlet and pushes the slider to slide in a direction of releasing the dust outlet lid.

36. The cleaning apparatus assembly according to claim 28, wherein:

the cleaning apparatus has a main suction channel for supplying air to the dust cup component and an air outlet for discharging air;

the cleaning apparatus further comprises a closing component configured to close the main suction channel when triggered;

the dust accumulation base has a trigger, and after the dust accumulation base and the cleaning apparatus are fitted in place, the dust inlet is butt-jointed to the dust outlet lid of the dust cup component, and the trigger triggers the closing component to close the main suction channel.

37. The cleaning apparatus assembly according to claim 36, wherein:

the dust cup component has a dust cup inlet;

the cleaning apparatus comprises an air inlet pipe having an end configured as a connection opening coupled to the dust cup inlet, and the main suction channel is defined in the air inlet pipe;

the closing component extends into a space between the connection opening and the dust cup inlet when triggered.

38. The cleaning apparatus assembly according to claim 37, wherein the cleaning apparatus further comprises:

a first seal member arranged around the dust cup inlet; and a second seal member arranged around the connection opening, wherein the closing component extends into a space between the first seal member and the second seal member when triggered.

39. The cleaning apparatus assembly according to claim 36, wherein a main body of the cleaning apparatus comprises the dust cup component and the body component, the cleaning apparatus further comprises an accessory detachably coupled to the main body, and the closing component is arranged on the main body.

40. The cleaning apparatus assembly according to claim 36, wherein the closing component comprises:

a closing door having a closed position for closing the main suction channel and an open position for opening the main suction channel;

an open return member driving the closing door to move toward the open position; and an adjusting member coupled to the closing door and configured to drive the closing door to move when triggered.

41. The cleaning apparatus assembly according to claim 40, wherein the cleaning apparatus comprises a protective shell covering an outer side of the main suction channel, an accommodation chamber is defined between the protective shell and an outer wall of the main suction channel, and the closing component is located in the accommodation chamber.

42. The cleaning apparatus assembly according to claim 41, wherein a sliding groove is formed in the protective shell, and the adjusting member extends out of the cleaning apparatus from the sliding groove.

43. The cleaning apparatus assembly according to claim 41, wherein the closing component comprises a guide sheet, the guide sheet is annular or semi-annular and fitted over the main suction channel, and the closing door is coupled to the guide sheet.

44. The cleaning apparatus assembly according to claim 40, wherein the dust outlet lid is located at an axial end of the dust cup component, the closing door is slidable in a direction parallel to an axis of the dust cup component, and the open return member pushes the closing door towards the dust outlet.

* * * * *